United States Patent [19]

Tanabe

[11] Patent Number: 4,699,518

[45] Date of Patent: Oct. 13, 1987

[54] MUSICAL SCALE GENERATING CIRCUIT

[75] Inventor: Tohru Tanabe, Showa, Japan

[73] Assignee: Rhythm Watch Company Limited, Tokyo, Japan

[21] Appl. No.: 906,758

[22] Filed: Sep. 11, 1986

[30] Foreign Application Priority Data

Sep. 12, 1985 [JP] Japan ..... 60-202466

[51] Int. Cl.[4] ..... G04B 21/02; G10H 1/00

[52] U.S. Cl. ..... 368/75; 368/273; 84/1.01; 84/1.03

[58] Field of Search ..... 368/75, 272–273; 84/1.01, 1.03, 1.24

[56] References Cited

U.S. PATENT DOCUMENTS

| | | | |
|---|---|---|---|
| 4,245,336 | 1/1981 | Stietenroth | 368/75 |
| 4,271,495 | 6/1981 | Scherzinger et al. | 368/75 |
| 4,368,989 | 1/1983 | Kawashima | 368/273 |
| 4,481,852 | 11/1984 | Makuta et al. | 84/1.03 |
| 4,488,272 | 12/1984 | Scott, Jr. | 368/75 |

*Primary Examiner*—Vit W. Miska
*Attorney, Agent, or Firm*—Koda and Androlia

[57] ABSTRACT

A musical scale generating circuit comprises an oscillator, a programmable frequency divider for frequency-dividing an output signal from the oscillator, a tone generating circuit for generating a tone, and a frequency dividing ratio data output circuit for successively outputting frequency dividing ratio data determinative of a plurality of frequency dividing ratios of the programmable frequency divider. A frequency dividing ratio discriminating circuit detects whether a frequency dividing ratio necessary for outputting a desired scale frequency is an odd or even number. A frequency dividing ratio correcting circuit is operative to add one to or substract one from frequency dividing ratio data, when a frequency dividing ratio is detected to be an odd numbered frequency dividing ratio and applies corrected frequency dividing ratio to the programmable frequency divider. A one-half frequency divider further divides a signal from the programmable frequency divider by two.

8 Claims, 39 Drawing Figures

MUSICAL SCALE GENERATING CIRCUIT

BACKGROUND OF THE INVENTION

1. Field of the Invention

This invention relates to improvements in a musical scale generating circuit used in melody generators of the electronic timepiece, and more particularly to a musical scale generating circuit capable of obtaining a desired scale frequency (especially one associated with a frequency dividing ratio that is odd number) from a low-frequency source.

2. Prior Art

A conventional timepiece melody generator of this type is disclosed in the specification of Japanese Patent Application Laid-Open No. 56-133674.

FIG. 35 is a block diagram illustrating this conventional melody generator.

The generator includes a programmable frequency divider 4 for dividing a high-frequency signal from an oscillator 2 on the basis of frequency dividing ratio data from a ROM 6 storing frequency dividing ratios in a sequence corresponding to a melody, and for applying the resulting signal to a tone generating circuit 8 which proceeds to generate a tone of a desired scale.

The frequency dividing ratio data stored in the ROM 6 are decided in the following manner.

If the melody is, for example, the same as that produced by the clock at Westminster Abbey, the scales used to generate it are of four types, namely $C_5$# (about 555 Hz), $B_4$ (about 496 Hz), $A_4$ (about 443 Hz) and $E_4$ (about 331 Hz). By combining these four scales, four melodies indicating an on-the-hour time, quarter past, half past and quarter of the hour are produced, and the "Westminster melody" is constituted by these four melodies.

The sequence through which the scales of the on-the-hour, quarter-past, half-past and quarter-of melodies are combined is as illustrated in Table I.

TABLE I

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| ON THE HOUR | $A_4$ | $C_5$ # | $B_4$ | $E_4$ | $A_4$ | $B_4$ | $C_5$ # | $A_4$ | $C_5$ # | $A_4$ | $B_4$ | $E_4$ | $E_4$ | $B_4$ | $C_5$ # | $A_4$ |
| 15 MIN AFTER | $C_5$ # | $B_4$ | $A_4$ | $E_4$ | | | | | | | | | | | | |
| 30 MIN AFTER | $A_4$ | $C_5$ # | $B_4$ | $E_4$ | $A_4$ | $B_4$ | $C_5$ # | $A_4$ | | | | | | | | |
| 45 MIN AFTER | $C_5$ # | $A_4$ | $B_4$ | $E_4$ | $E_4$ | $B_4$ | $C_5$ # | $A_4$ | $C_5$ # | $B_4$ | $A_4$ | $E_4$ | | | | |

If scale frequencies corresponding to the respective scales are outputted by the programmable frequency divider 4 in the order of the scales shown in Table I, the tone generating circuit 8 will generate the "Westminster melody".

Accordingly, if the frequency dividing ratios of the programmable frequency divider 4 for outputting the scale frequencies are made to correspond to respective ones of these scales and these frequency dividing ratios are set and stored in the ROM 6 in order in place of the scales of Table I, then the programmable frequency divider 4 will sucessively output scale frequency signals conforming to the respective scales of the melody.

It is assumed that the oscillator 2 employs a quartz oscillator and that the programmable frequency divider 4 used in the generator of FIG. 35 has a seven-bit preset input and is capable of dividing by a maximum of 128. Table II shows the corresponding scales, scale frequencies and frequency dividing ratios in such case.

TABLE II

| Oscillator Frequency | Scale | Scale Frequency | Dividing Ratio |
|---|---|---|---|
| 32,768 Hz | $C_5$ # | 555.390 Hz | 59 |
| | $B_4$ | 496.485 Hz | 66 |
| | $A_4$ | 442.811 Hz | 74 |
| | $E_4$ | 330.990 Hz | 99 |

As shown in Table II, a scale frequency corresponding to each scale can be obtained by dividing the output signal of the oscillator 2 at the respective frequency dividing ratio.

The ROM 6 practically stores the frequency dividing data which is the complement, in the form of a binary number, of each frequency dividing ratio, namely 69 (128−59) for the frequency dividing ratio 59, 62 (128−66) for the frequency dividing ratio 66, etc., as shown in Table III. These complementary numbers are successively applied to the programmable frequency divider 4 as the frequency dividing data.

TABLE III

| Scale | Binary Number | |
|---|---|---|
| $C_5$ # | 1000101 | complement of 59 |
| $B_4$ | 0111110 | complement of 66 |
| $E_4$ | 0110110 | complement of 74 |
| $A_4$ | 0011101 | complement of 99 |

When these frequency dividing ratio data are fed into the programmable frequency divider 4, the latter is forcibly preset and starts counting from the numerical values (69, 62, 54, 29) until the final stage. The end result is that the signal from the oscillator 2 is frequency-divided at the frequency dividing ratios 59, 66, 74, 99.

When the programmable frequency divider 4 is forcibly preset in mid-course as in the prior art described above, the scale frequency signals obtained as a result are as depicted in FIG. 36. The signals do not exhibit a duty cycle of 50% and contain various high-frequency components. The resulting problem is that the tone generating circuit 8 does not generate a clear tone.

Measures have been considered for solving the foregoing problem.

Specifically, as shown in FIG. 37, a ½ frequency divider 10 is provided at the output of the programmable frequency divider 4 shown in FIG. 35 in order to frequency-divide the output of the programmable frequency divider 4 by two. Though the duty cycles can be made 50% by providing the ½ frequency divider 10, the frequency dividing ratios of the programmable frequency divider 4 in such case must be set beforehand to one-half those indicated in Table II. This means that the frequency dividing ratios 66 ($B_4$), 74 ($A_4$) need only be set to 33, 37, respectively. However, when performing frequency division at the ratios 59 ($C_5$#), 99 ($E_4$), frequency dividing ratios that are one-half these values cannot be produced. Therefore, it is necessary that the output frequency of the oscillator be increased twofold (to 64 KHz).

Since a source of such high-frequency oscillation employs a large number of cascaded flip-flops, the oscillator is higher in cost and consumes a greater amount of power.

SUMMARY OF THE INVENTION

Accordingly, it is the primary object of this invention to provide a musical scale generating circuit for producing a clear tone and for reducing cost and power consumption.

In keeping with principles of the present invention, the object is accomplished by following basic structure and operation thereof.

As shown in the basic block diagram of FIG. 38, the present invention provides a musical scale generating circuit of the type having an oscillator 12, a programmable frequency divider 14 for frequency-dividing an output signal from the oscillator 12, a tone generating circuit 16 for generating a tone in response to an output signal from the programmable frequency divider 14, and a frequency dividing ratio data output circuit 18 for successively outputting frequency dividing ratio data determinative of a plurality of frequency dividing ratios of the programmable frequency divider 14, whereby the programmable frequency divider 14 successively outputs desired scale frequencies. The frequency dividing ratio data output circuit 18 is set in such a manner that when a frequency dividing ratio necessary for outputting a desired scale frequency is an even number, data indicative of a frequency dividing ratio that is one-half the even-numbered frequency dividing ratio are delivered, and when a frequency dividing ratio necessary for outputting a desired scale frequency is an odd number, data indicative of a frequency dividing ratio that is one-half of a frequency dividing ratio having a value one more or one less than the odd-numbered frequency dividing ratio are delivered. The musical scale generating circuit is provided with a frequency dividing ratio discriminating circuit 20 for detecting whether a frequency dividing ratio necessary for outputting a desired scale frequency is an odd or even number, a frequency dividing ratio correcting circuit 22 which, when a frequency dividing ratio is detected to be an odd-numbered frequency dividing ratio by the frequency dividing ratio discriminating circuit 20, is operative to add one to or substract one from frequency dividing ratio data, which are applied to the programmable frequency divider 14, in order to correct for a quantity added to or subtracted from a frequency dividing ratio necessary for outputting a desired scale frequency in the frequency dividing ratio data output circuit 18, and a ½ frequency divider 24 for further frequency-dividing a signal from the programmable frequency divider 14 by two.

Thus, when it is necessary to frequency-divide the 32,768 Hz frequency of the oscillator 12 by 66 in order to obtain a desired scale frequency of 496 Hz, one-half this dividing ratio (33) is delivered by the frequency dividing ratio output circuit 18 as the frequency dividing ratio data. At this time the frequency dividing ratio discriminating circuit 20 detects that the original frequency dividing ratio (66) is an even number, so that the frequency dividing ratio correcting circuit 22 applies the frequency dividing ratio data (33) to the programmable frequency divider 14 without change.

If frequency division by 59 is required in order to obtain the desired scale frequency of 555 Hz, on the other hand, the frequency dividing ratio data output circuit 18 outputs, as frequency dividing ratio data, a frequency dividing ratio (29) that is one-half of a frequency dividing ratio (58) obtained by subtracting one from (or adding one to) the above frequency dividing ratio (59). The frequency dividing ratio 29 is delivered to the programmable frequency divider 14 without change. At this time the frequency dividing ratio discriminating circuit 20 detects that the original frequency dividing ratio (59) is an odd number, so that the frequency dividing ratio correcting circuit 22 adds (or substracts) one, which was substracted from (or added to) the frequency dividi ratio (59), to (or from) the frequency dividing ratio data (29), to make this data equal to 30 (or 28). Hence, a frequency dividing ratio of 30 is applied to the programmable frequency divider 14. As a result, in the output waveform of the ½ frequency divider 24, the initial L- (or H-) level portion thereof is frequency-divided by 29 by the programmable frequency divider 14, and the subsequent H- (or L-) level portion thereof is frequency-divided by 30 by the programmable frequency divider 14, so that the end result is frequency division by 59 overall. Therefore, according to the invention, the duty cycle is made approximately 50%.

DETAILED DESCRIPTION OF THE INVENTION

Figure 1A:
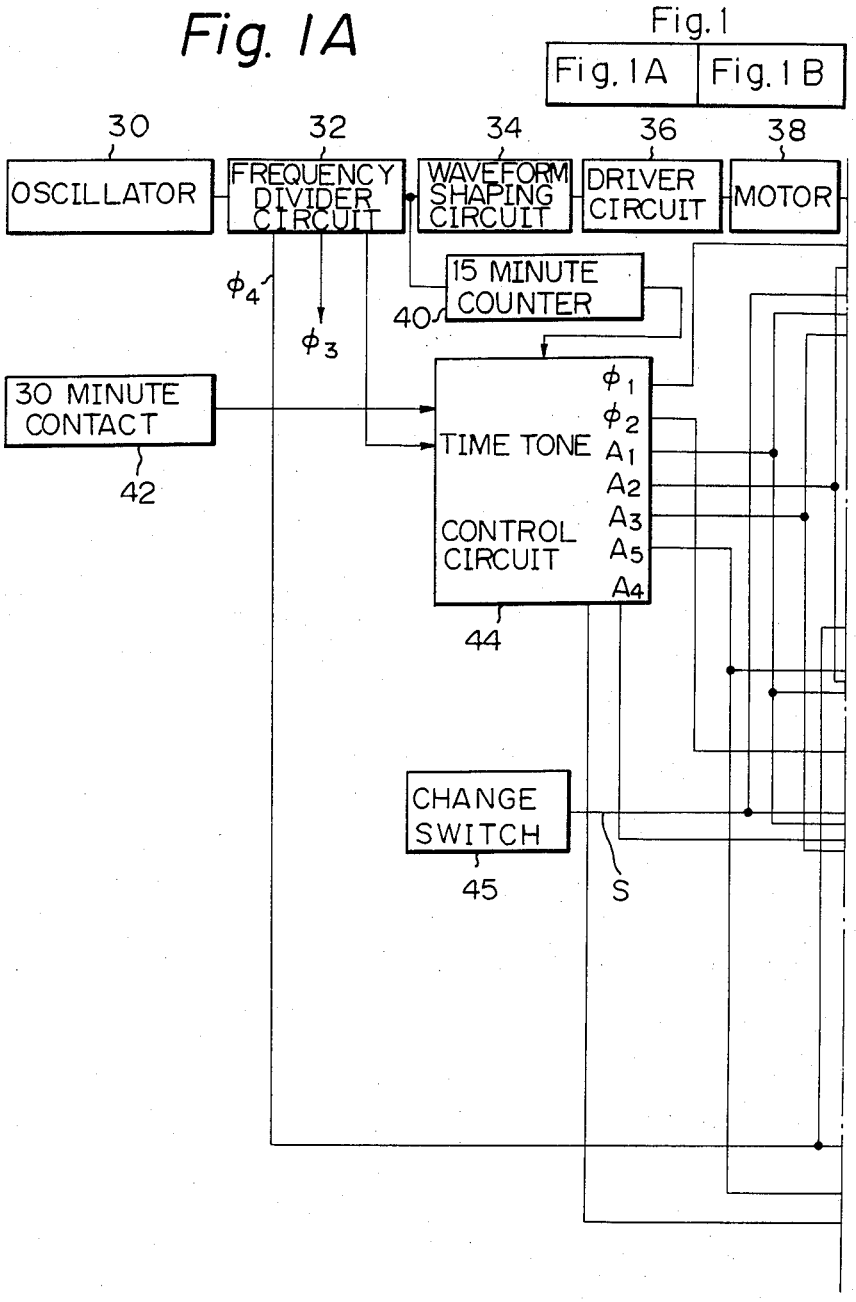
FIG. 1 is a block diagram illustrating an example in a musical scale generating circuit embodying the present invention is applied to a timepiece.
Figure 1B:
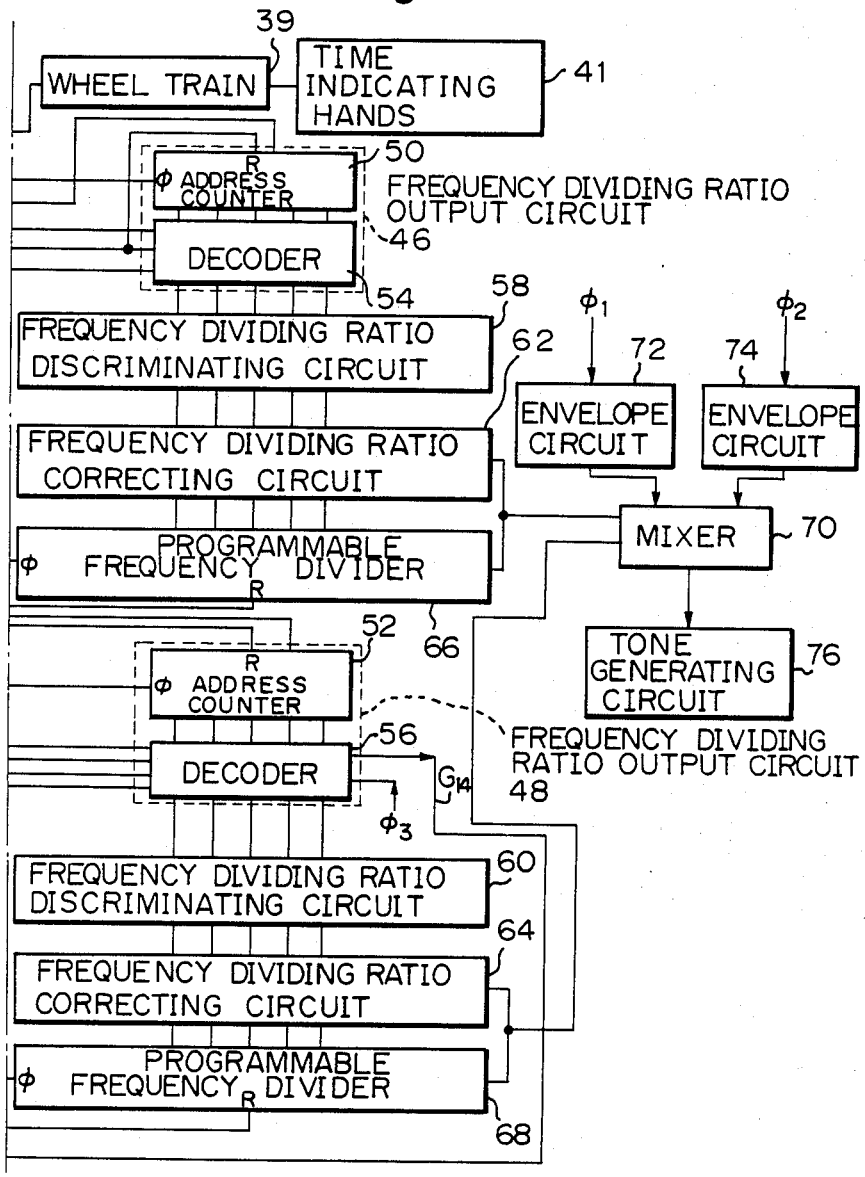

Referring now to FIG. 1, numeral 30 denotes an oscillator which, in the illustrated embodiment, employs a quartz oscillator producing an output signal having a frequency of 32,768 Hz.

Numeral 32 denotes a frequency divider circuit for frequency-dividing the output signal of oscillator 30; 34 a waveform shaping circuit for shaping the waveform of a 1 Hz signal outputted by the frequency divider circuit 32; 36 a driver circuit for converting the shaped signal into a drive signal; 38 a motor rotated in response to the drive signal applied thereto; 39 a wheel train driven by the motor 38; and 41 time indicating hands driven by the wheel train 39.

Numeral 40 denotes a 15-minute counter, to which the 1 Hz signal from the frequency divider 32 is applied, for outputting a signal every 15 minutes, and numeral 42 designates a 30-minute contact for outputting a signal every 30 minutes with rotation of the wheel train 39 driven by the motor 38.

A time tone control circuit 44 receives signals from the frequency divider circuit 32, 15-minute counter 40 and 30-minute contact 42 for outputting note length signals $\phi_1$, $\phi_2$ indicating the type of notes in a melody, namely the length of the notes, signals $A_1$–$A_4$ for discriminating an on-the-hour time, 15, 30 and 45 minutes after the hour, respectively, and a signal $A_5$ for establishing a tone generating state.

Numeral 45 denotes a change switch providing a signal S for changing over the type of a clock beat tone for a case where clock beat tones are generated.

Numerals 46, 48 represents frequency dividing ratio output circuits respectively comprising address counters 50, 52 and decoders 54, 56. The address counters 50, 52 are placed in an operative state when the signal $A_1$ falls to the L level and, when the respective note length signals $\phi_1$, $\phi_2$ are applied thereto in such state, produce output signals. The decoders 54, 56 deliver frequency dividing ratio data signals upon receiving signals from the address counters 50, 52, respectively.

Numerals 58, 60 denote frequency dividing ratio discriminating circuits which discriminate whether a frequency dividing ratio for obtaining a desired scale frequency signal is an odd number. Numerals 62, 64 designate frequency dividing ratio correcting circuits which add one to the frequency dividing ratio data outputted by the decoders 54, 56 to correct these data, respectively, when the frequency dividing ratio discriminating circuit 58, 60 discriminate that the desired frequency dividing ratio is an odd number.

Programmable frequency dividers 66, 68 are adapted to divide by 64 in the illustrated embodiment and have a ½ frequency divider connected to the output side of a final stage thereof.

Numeral 70 represents a mixer to which the frequency signals from the programmable frequency dividers 66, 68 are applied for mixing these with envelope signals from envelope circuits 72, 74.

Numeral 76 denotes a tone generating circuit for generating a tone upon receiving a signal from the mixer 70.

Two musical scale generating circuits are employed in the illustrated embodiment. The reason for this is to have the two musical scale generating circuits successively produce, in alternating fashion, the scales shown in Table I so that the sound generated will approach that produced when a bell is actually struck.

The construction and operation of the various circuits will now be described with reference to more detailed circuit diagrams and the timing charts therefor.

Figure 2:
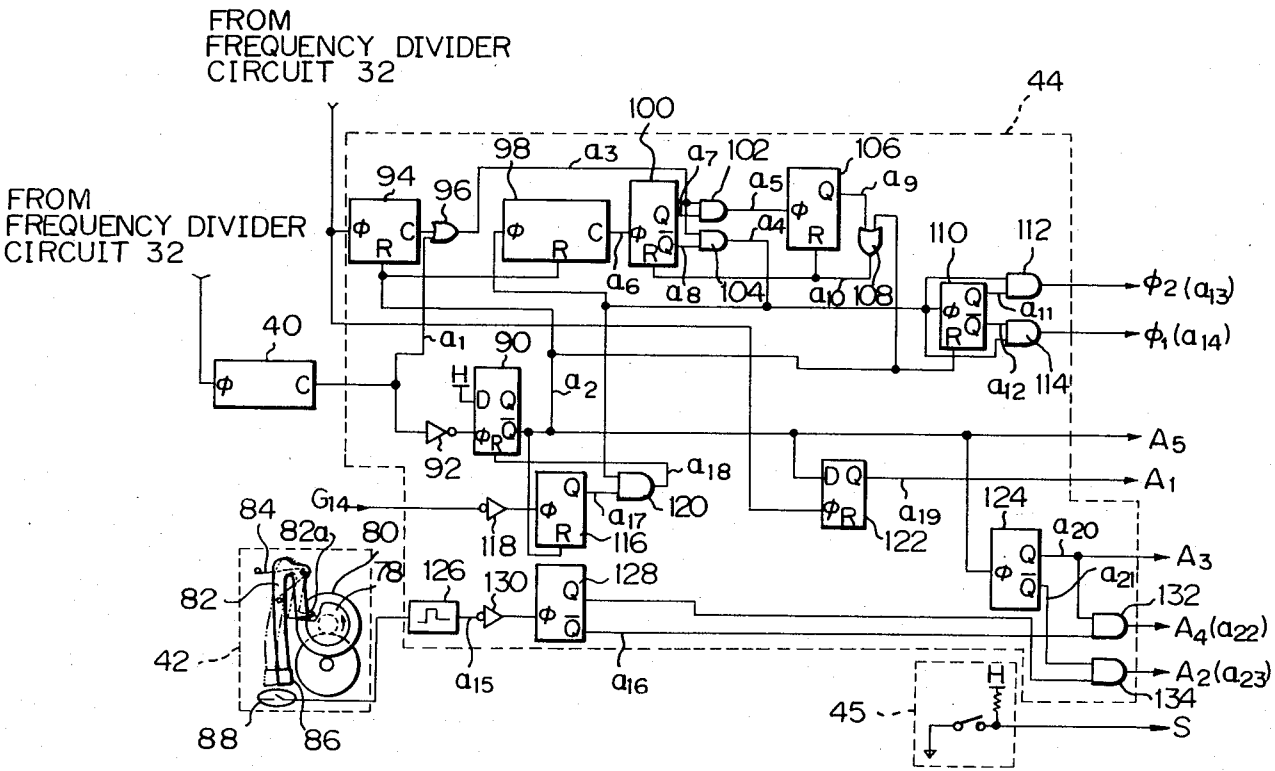
FIG. 2 is a view illustrating the detailed circuit construction of a tone control circuit shown in FIG. 1.

FIG. 2 shows the detailed construction of the time tone control circuit 44, 15-minute counter 40, 30-minute contact 42 and change switch 45 shown in FIG. 1.

The 30-minute contact 42 comprises a cam 78 fixed to a wheel 80 which rotates once in every half-hour, a lever 82 urged in the counter-clockwise direction by a spring 84, a magnet 86 provided at one end of the lever 82 and a switch 88 disposed adjacent the magnet 86. The lever 82 is normally positioned as shown by the dotted line with the magnet 86 away from the switch 88. In this state, the switch 45 is in an off condition. At the half-hour, a cam follower portion **82*a* provided at the other end of the lever 82 engages the notch of the cam 78, whereby the lever 82 rotates to the position shown by the solid line. As a result, the magnet 86 comes adjacent the switch 88, therefore, the switch 88** becomes the on condition and produces the 30-minute signal.

On the other hand, the 15-minute counter 40 is constructed by a counter which receives the 1 Hz signal from the frequency divider circuit 32 and counts this signal for 15 minutes to provide a 15-minute signal $a_1$.

Further, the change switch 45 is normally off state. The signal S is usually held to H level.

The time tone control circuit 44 is constructed by the following elements.

A flip-flop 90 is coupled to receive the inverted 15-minute signal $\bar{a}_1$ through an inverter 92 into the clock input $\phi$ thereof to provide a signal $a_2$ from the output $\bar{Q}$. A counter 94 receives the clock signal from the frequency divider circuit 32 and the signal $a_2$ from the flip-flop 90 into the clock input $\phi$ and reset input R, respectively. The counter 94 counts a predetermined period and provides pulses each having a period equal to the length of a quarter note. An OR gate 96 receives the output signal of the counter 94 and the 15-minute signal $a_1$ to provide a signal $a_3$. A counter 98 is coupled to receive the signal $a_2$ and signal $a_4$ into the reset input R and clock input $\phi$, respectively. The counter 98 takes a count of pulses produced in the signal $a_4$ and provides a pulse in the output signal $a_6$ when counting five pulses. A flip-flop 100 has a clock input $\phi$ to which the signal $a_6$ is applied and changes the state of the outputs Q, $\bar{Q}$ in response to the negative-going transition of the signal $a_6$. An AND gate 102 is coupled to receive the signal $a_3$ and signal $a_7$ to provide a signal $a_5$. An AND gate 104 is coupled to receive the signal $a_3$ and signal $a_8$ to provide the signal $a_4$. A flip-flop 106 has a clock input $\phi$ to which the signal $a_5$ is applied. The flip-flop 106 changes the state of the output signal $a_9$ in response to the negative-going transition of the signal $a_5$. An OR gate 108 receives the signal $a_2$ and $a_9$ and applies a signal $a_{10}$ to the reset inputs R of the flip-flops 100, 106. A flip-flop 110 has a clock input $\phi$ and reset input R to which the signal $a_4$, $a_2$ is applied, respectively. The flip-flop 110 changes the states of the outputs Q, $\bar{Q}$ in response to the negative-going transitions of the signal $a_4$. An AND gate 112 has one input terminal to which the output signal $a_{11}$ of the flip-flop 110 is applied and the other input terminal to which the signal $a_4$ is applied. An AND gate 114 has one input terminal to which the output signal $a_{12}$ of the flip-flop 110 is applied and the other input terminal to which the signal $a_4$ is applied. The AND gates 112, 114 supply the signal $\phi_2$ ($a_{13}$), $\phi_1(a_{14})$, respectively. A flip-flop 116 receives the inverted output signal $\overline{G_{14}}$ of the decoder 56 into the clock input $\phi$ through the inverter 118 and the signal $a_2$ into the reset input R. An AND gate 120 coupled to receive the output signal $a_{17}$ of the flip-flop 116 and the signal $a_4$ and applies a signal $a_{18}$ to the reset input R of the flip-flop 90. An flip-flop 122 has a clock input $\phi$ to which the clock signal from the frequency divider circuit 32 is applied and a data input D to which the signal $a_2$ is applied. This flip-flop 122 supplies a signal $a_{19}(A_1)$. An flip-flop 124 is coupled to receive the signal $a_2$ into the clock input $\phi$ and provides signals $a_{20}$ and $a_{21}$ from the outputs Q and $\overline{Q}$, respectively. An one-shot multivibrator 126 provides a pulse in response to the 30-minute signal from the 30-minute contact 42. An flip-flop 128 receives the inverted output signal $\overline{a_{15}}$ of the one-shot multivibrator 126 through the inverter 130. The flip-flop 128 changes the state of signals from the respective outputs Q, $\overline{Q}$ in response to the negative-going transition of the inverted signal $\overline{a_{15}}$. An AND gate 132 is coupled to receive the signal $a_{20}$ and the signal $a_{16}$ from the flip-flop 128 and supplies the signal $a_{22}(A_4)$. An AND gate 134 is coupled to receive the signal $a_{21}$ and the signal from the output Q of the flip-flop 128 and supplies the signal $a_{23}(A_2)$.

The operation of the time tone control circuit 44 will now be described with reference to the timing charts of FIGS. 3 and 4.

Figure 3:
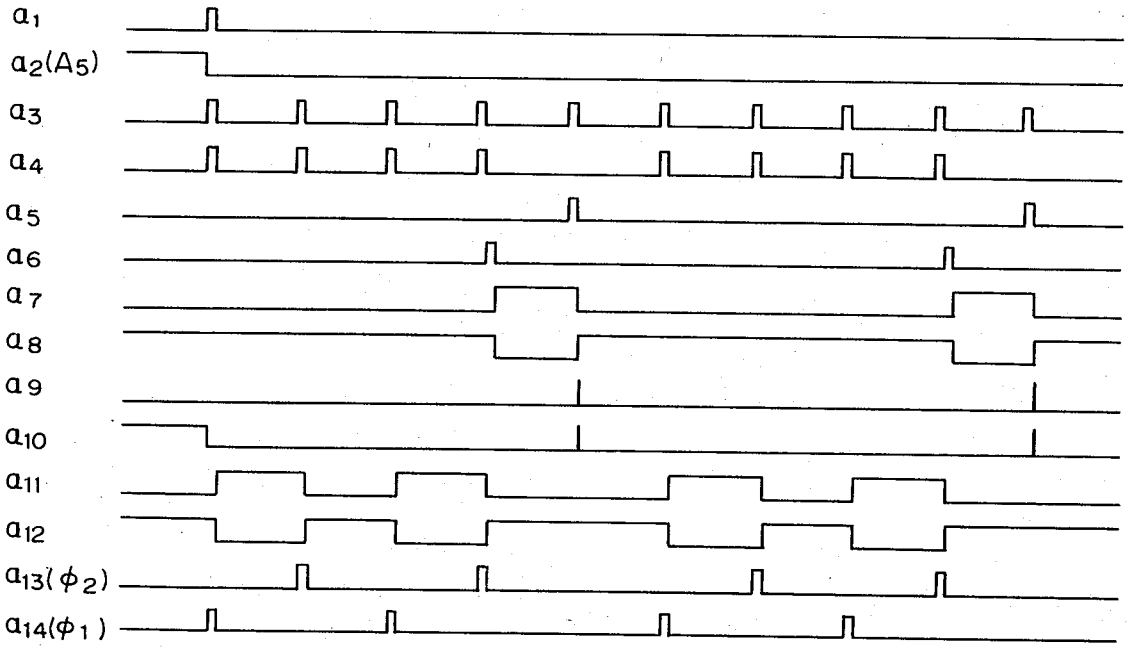
FIGS. 3 and 4 are timing charts of signals in the tone control circuit of FIG. 2.
Figure 4:
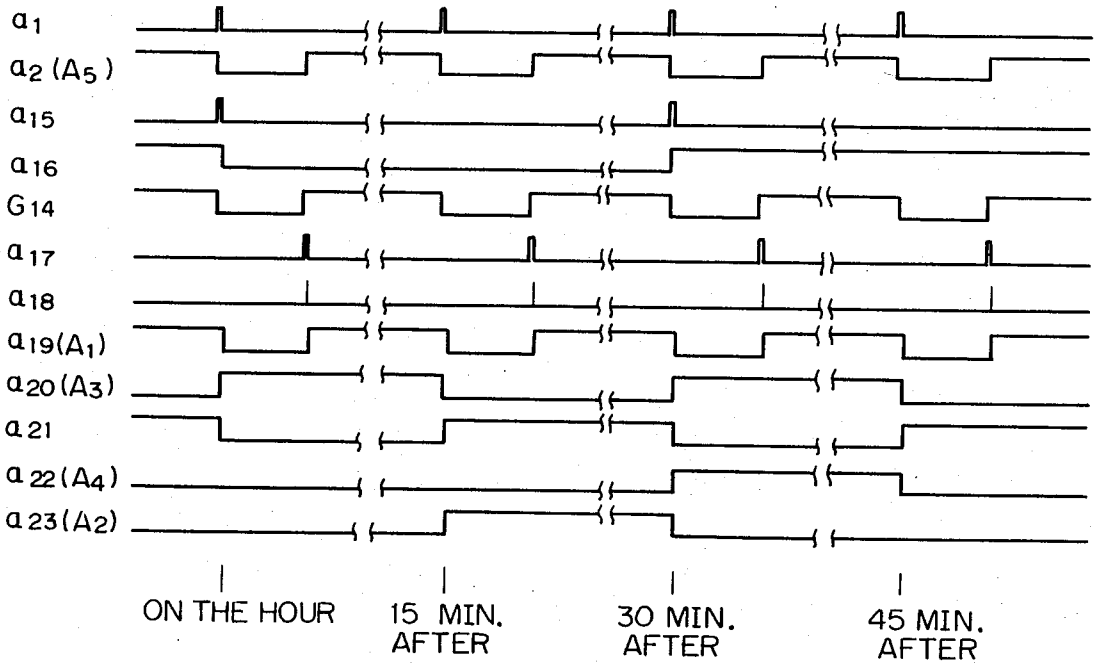

When the 15-minute counter 40 produces the pulse in the output signal $a_1$ as shown in FIG. 3, the pulse is inverted and applied to the clock signal terminal $\phi$ of the flip-flop 90 through the inverter 92. The flip-flop 90 changes the state of the output signal $a_1$ to the L level in synchronism with the negative-going transition of the inverted signal $\overline{a_2}$. As a result, the counters 94, 98 and flip-flop 110 are released from the reset state, whereby the counter 94 starts in count. At the same time, the pulse of the 15-minute signal $a_1$ is applied to the AND gates 102, 104 through the OR gate 96. The flip-flop 100 is initially reset, therefore, the output signal $a_8$ is the H level, and the AND gate 104 is in the open state. Thus, the pulse which is applied to the AND gate 104 appears in the output signal $a_4$. The pulse of the signal $a_4$ is applied to the flip-flop 110 which is initially reset and the AND gates 112, 114. The AND gate 114 is in the open state owing to H-level input signal $a_{12}$, whereby the pulse appears in the signal $\phi_1(a_{14})$. Then, the flip-flop 110 changes the output signals $a_{11}$, $a_{12}$ into H, L level, respectively, in synchronism with the negative-going trabsition of the pulse of the signal $a_4$. When the next pulse appears in the signal $a_4$, this pulse appears in the signal $\phi_2(a_{13})$ through the AND gate 112. Thus, when the pulses which are supplied from the 15-minute counter 40 and the counter 94 appear in the signal $a_4$ through the OR gate 96 and AND gate 104, these pulses alternately appear in the signals $\phi_1(a_{14})$, $\phi_2(a_{13})$.

At the same time, the pulses produced in the signal $a_4$ are applied to the counter 98. The counter 98 counts the pulses of the signal $a_4$. When counting fourth pulse, the counter 98 provides a pulse in the output signal $a_6$. The flip-flop 100 changes the state of the output signals $a_7$, $a_8$ in response to the pulse of the signal $a_6$, whereby the AND gate 102 is in the open state. Then, the fifth pulse of the signal $a_3$ appears in the signal $a_5$ through the AND gate 102. The flip-flop 106 changes the state of the signal $a_9$ in the H level. Further, the flip-flops 106, 100 are reset by the signal $a_9$ through the OR gate 108. As a result, the fifth pulse of the signal $a_3$ doesn't appear in the signal $\phi_1$ or $\phi_2$, and the tone caused by the fourth pulse of the signal $a_3$ is maintained for a double duration in comparison with the other tones. This operation is repeated until the signal $G_{14}$ is raised to the H level.

In this embodiment, the melody composed of bars each having three quarter notes and one half note, e.g. melody of "Westminster Clock" is employed. Namely, in above-mentioned operation, the first to third pulses produced in the signals $\phi_1$ and $\phi_2$ are suitable for the three quarter notes, and the fourth pulse is suitable for the half note.

The signal $G_{14}$ falls to the L level when generating the melody is started, and raises to the H level when generating the melody is stopped. The flip-flop 116 changes the state of the output signal $a_{17}$ in response to the negative-going transition of the inverted signal $\overline{G_{14}}$, whereby the AND gate 120 is in the open state. At this time, the pulse which is provided in the signal $a_4$ appears in the signal $a_{18}$, thereby resetting the flip-flop 90. As a result, the counters 94, 98 and flip-flops 110, 116 are reset by the H-level signal $a_2$. The above-mentioned operation is attained every 15 minutes.

Further, when the 30-minute signal is provided from the 30-minute contact 42, the one-shot multivibrator 126 provides a pulse in the output signal $a_{15}$ and applies this pulse to the flip-flop 128 through the inverter 130. The flip-flop 128 changes the state of the output signals in synchronism with the negative-going transition of the inverted pulse. Therefore, the AND gates 132, 134 which receive the output signals of the flip-flop 128, respectively, become alternately the open state every 30 minutes. Further, the state of the output signals $a_{22}(A_4)$, $a_{23}(A_2)$ of the AND gates 132, 134 are decided in accordance with the state of the output signals $a_{20}$, $a_{21}$ of the flip-flop 124, in which the state of the signals $a_{20}$, $a_{21}$ are changed in response to the negative-going transition of the signal $a_2$. Further, the flip-flop 122 changes the state of the output signal $a_{19}$ in response to the negative-going transition of the clock signal from the frequency divider circuit 32 and the signal $a_2$. Thus, the negative-going transition of the signal $a_{19}$ lags behind the transition of the signal $a_2$ as far as one pulse of the clock signal.

FIGS. 5 through 9 show timing charts of the signals $A_1$–$A_5$, $\phi_1$ and $\phi_2$ shown in FIG. 2.

Figure 5:
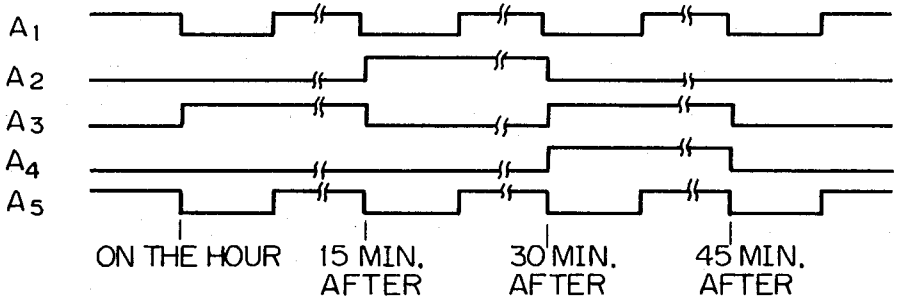
FIG. 5 is a timing chart of signals $A_1$–$A_5$ shown in FIG. 2.
Figure 6:
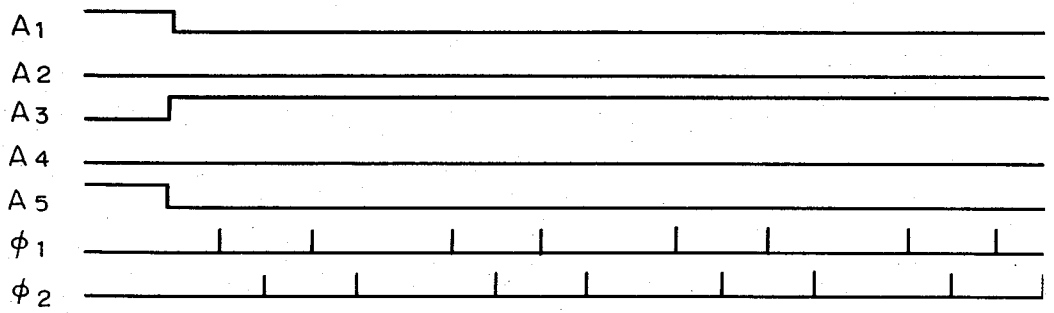
FIGS. 6 through 9 are timing charts of the signals $A_1$–$A_5$ shown in FIG. 2 at times on the hour, 15, 30 and 45 minutes after the hour.
Figure 7:
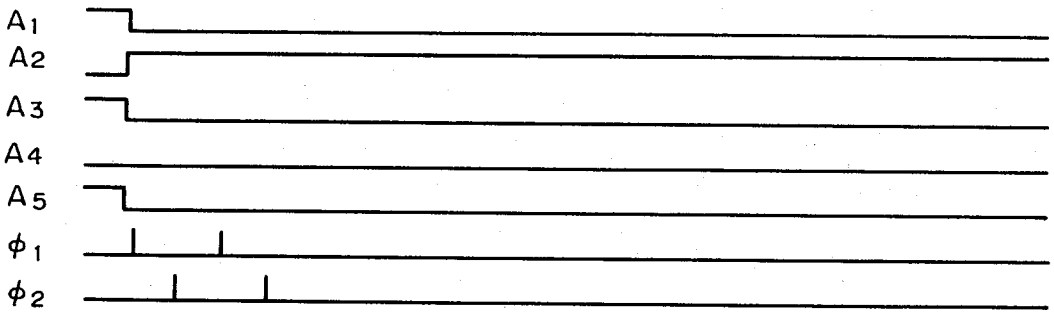
Figure 8:
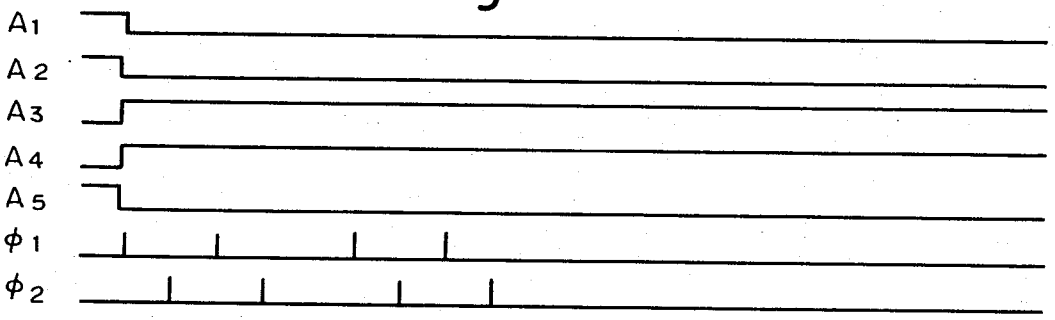
Figure 9:
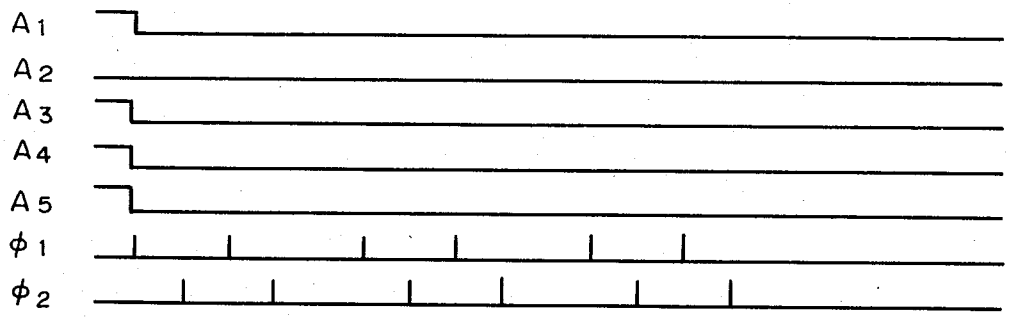

As shown in FIG. 5, the signal $A_5$ falls to the L level every 15 minutes to place the programmable frequency dividers 66, 68 in an operative state. The signal $A_1$ also falls to the L level every 15 minutes, this negative-going transition lagging alightly behind that of the signals $A_2$–$A_5$ as mentioned above. This will be described below. The signal $A_2$ rises to the H level 15 minute after every hour and falls to the L level 30 minutes after every hour for the purpose of detecting 15 minutes after the hour. The signal $A_3$, which rises to the H level every hour on the hour and 30 minutes after every hour, and which falls to the L level 15 minutes after attaining the H level, is for detecting every hour on the hour and 30 minutes after the hour. The signal $A_4$, which rises to the H level 30 minutes after every hour and falls to the L level 15 minutes after attaining the H level, is for discriminating on the hour and 30 minutes after the hour. As shown in the timing charts in FIGS. 2 through 9 for the times on the hour, 15, 30 and 45 minutes after the hour, pulses equivalent to the number of notes appear alternately in the note length signals $\phi_1$, $\phi_2$. The pulse interval indicates note length. In other words, the interval between the initial pulse of the signal $\phi_1$ and the next pulse of the signal $\phi_2$ is set to be equal to the length of a quarter note, and the interval between the fourth pulse of the signal $\phi_1$ and the fifth pulse of the signal $\phi_1$ is set to be equal to the length of a half note.

Figure 10:
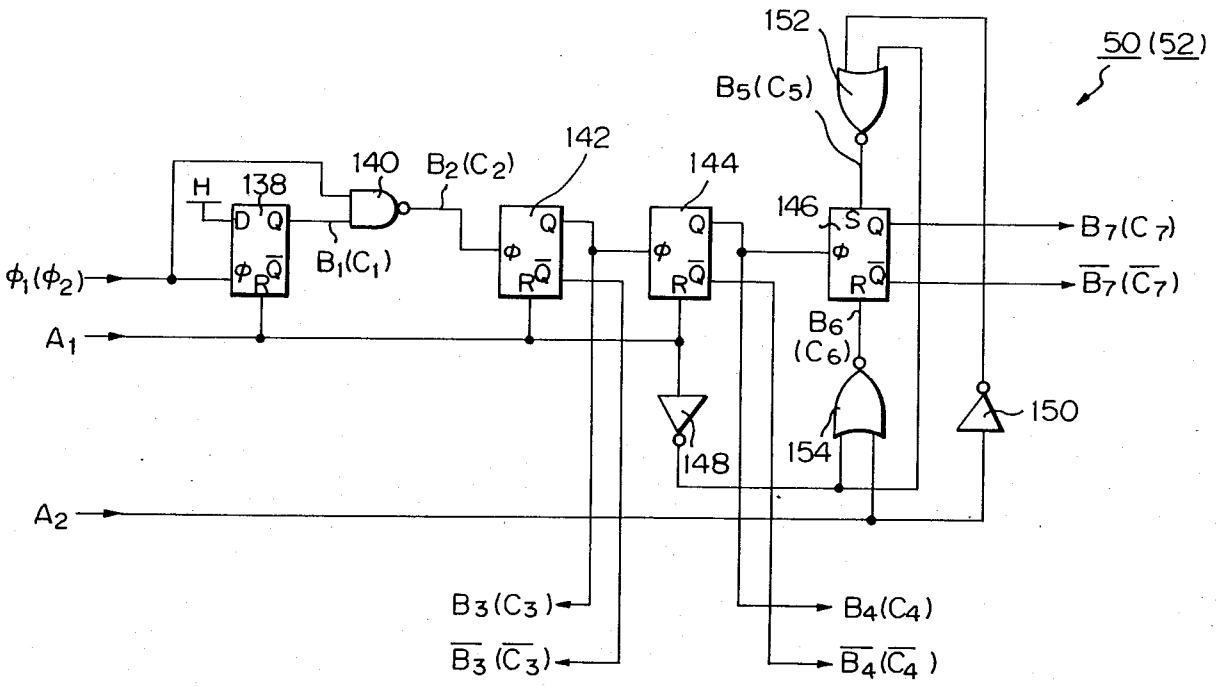
FIG. 10 is a view illustrating the detailed circuit construction of an address counter shown in FIG. 1.

FIG. 10 is a detailed circuit diagram illustrating the address counter 50 shown in FIG. 1. Since the address counter 52 is structurally identical with the address counter 50, only its input and output signals are indicated, these being enclosed by parentheses.

Numeral 138 denotes a flip-flop having the signal $\phi_1$ ($\phi_2$) applied to a clock input $\phi$ for outputting a signal $B_1$ ($C_1$) from an output Q.

Numeral 140 represents a NAND gate to which the signals $B_1(C_1)$ and $\phi_1(\phi_2)$ are applied for outputting a signal $B_2(C_2)$. A flip-flop 142 has a clock input $\phi$ to which the signal $B_2$ is applied and produces signals $B_3(C_3)$, $\overline{B}_3(\overline{C}_3)$ from outputs Q, $\overline{Q}$, respectively. A flip-flop 144 has a clock input $\phi$ to which the signal $B_3(C_3)$ is applied and produces signals $B_4(C_4)$, $\overline{B}_4(\overline{C}_4)$ from outputs Q, $\overline{Q}$, respectively. The signal $A_1$ is applied to the reset input R of these flip-flops 138, 142, 144.

Numeral 146 is a flip-flop having a clock input $\phi$ to which the signal $B_4(C_4)$ is applied, a set input S which receives a signal $B_5(C_5)$ from a NOR gate 152, to which the signals $A_1$, $A_2$ are applied via inverters 148, 150, respectively, and a reset input R which receives a signal $B_6(C_6)$ from a NOR gate 154, to which the signal $A_2$ is applied as well as the signal $A_1$, the latter via an inverter 148.

The operation of the address counter 50(52) will now be described with reference to FIGS. 11 through 14, which illustrate time charts for on the hour, 15 minutes after the hour, 30 minutes after the hour and 45 minutes after the hour, respectively.

Figure 11:
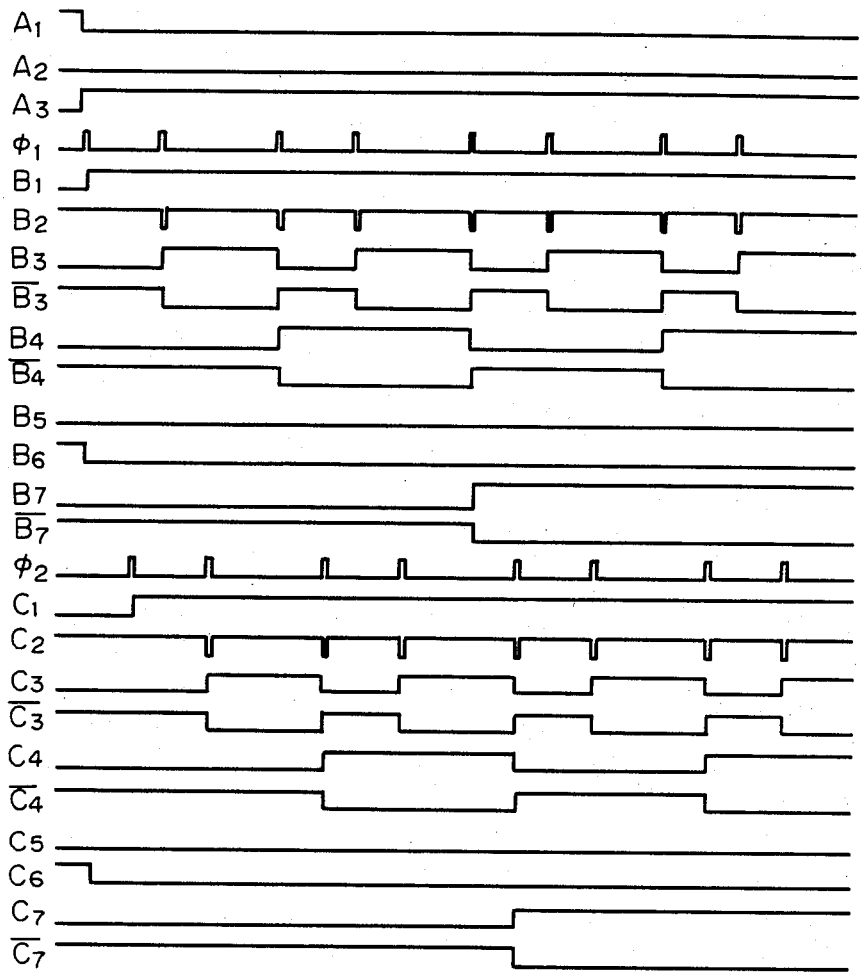
FIGS. 11 through 14 are timing charts of signals in the address counter of FIG. 10 at times on the hour, 15, 30 and 45 minutes after the hour.

As shown in FIG. 11, the signal $A_3$ attains the H level and the signal $A_1$ falls to the L level on the hour. When the signal $A_1$ falls to the L level, the flip-flops 138, 142, 144 are released from the reset state and a pulse appears in the signal $\phi_1(\phi_2)$ at the same time. The output signal $B_1(C_1)$ of flip-flop 138 rises to the H level in synchronism with the negative-going transition of the first pulse produced in the signal $\phi_1(\phi_2)$. As a result, the output signal $B_2(C_2)$ of NAND gate 140, to which the signal $B_1(C_1)$ is applied, falls to the L level whenever a pulse appears in the signal $\phi_1(\phi_2)$. The flip-flop 142, to which the signal $B_2(C_2)$ is applied, switches over the state of the output signals $B_3(C_3)$, $\overline{B}_3(\overline{C}_3)$ in synchronism with the negative-going transitions of the signal $B_2(C_2)$. Further, the flip-flop 144 changes over the state of the output signals $B_4(C_4)$, $\overline{B}_4(\overline{C}_4)$ in synchronism with the negative-going transitions of the signal $B_3(C_3)$, and also the flip-flop 144, to which the signal $B_4(C_4)$ is applied, changes over the state of the output signals $B_7(C_7)$, $\overline{B}_7(\overline{C}_7)$ in synchronism with the negative-going transitions of the signal $B_4(C_4)$.

Figure 12:
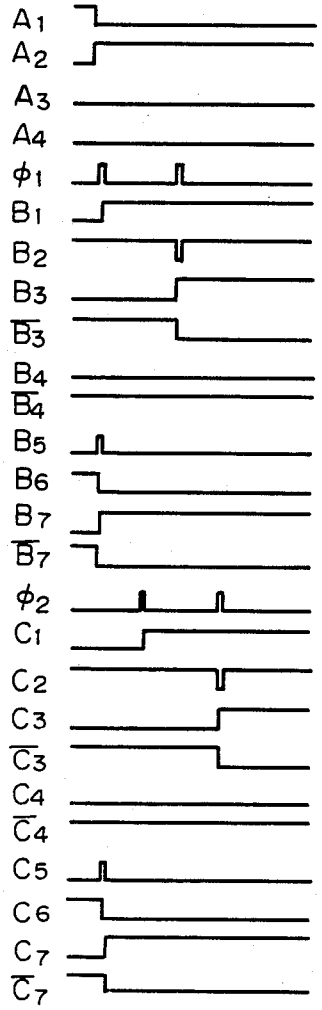

Next, at 15 minutes after every hour, as shown in FIG. 12, the signal $A_2$ attains the H level. The signal $A_1$ falls to the L level shortly after the signal $A_2$ rises. Owing to this delay in the decay of the signal $A_1$, a pulse appears in the output signal $B_5(C_5)$ of NOR gate 152, in response to which the flip-flop 146 is set. Thereafter, in a manner similar to that described above in connection with the on-the-hour time, the flip-flops 138, 142 released from the reset change the state of their output signals $B_1(C_1)$, $B_3(C_3)$, $\overline{B}_3(\overline{C}_3)$ in response to the pulse that appears in the signal $\phi_1(\phi_2)$.

Figure 13:
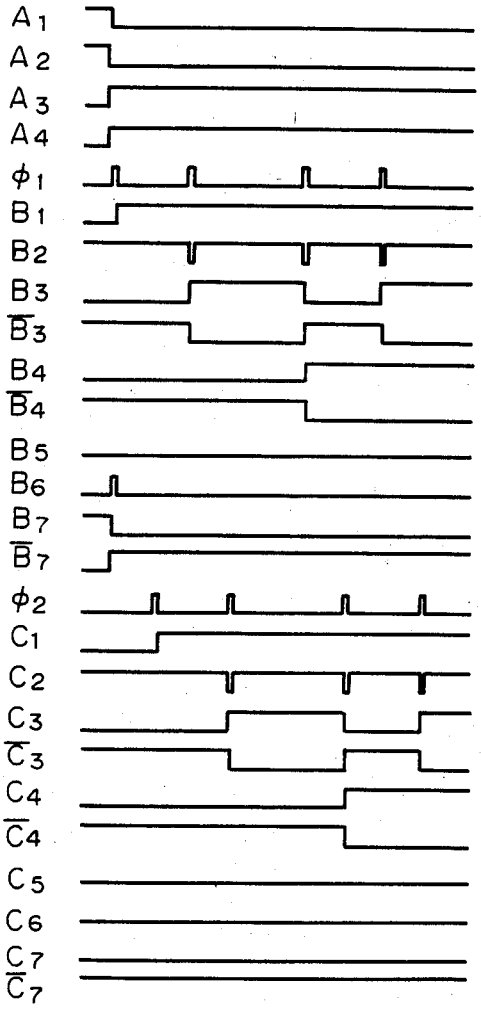

At 30 minutes after hour, as shown in FIG. 13, the signal $A_2$ falls to the L level and the signals $A_3$, $A_4$ rise to the H level. The signal $A_1$ falls to the L level shortly after the signals $A_2$–$A_5$ change state. Therefore, a pulse appears in the output signal $B_6(C_6)$ of NOR gate 159 to reset the flip-flop 146, which was set at 15 minutes after the hour. Thereafter, in a manner similar to that described above in connection with the on-the-hour time, the flip-flops 138, 142, 144 released from the reset state change the state of their output signals $B_1(C_1)$, $B_3(C_3)$, $\overline{B}_3(\overline{C}_3)$, $B_4(C_4)$, $\overline{B}_4(\overline{C}_4)$ in response to the pulse that appears in the signal $\phi_1(\phi_2)$.

Figure 14:
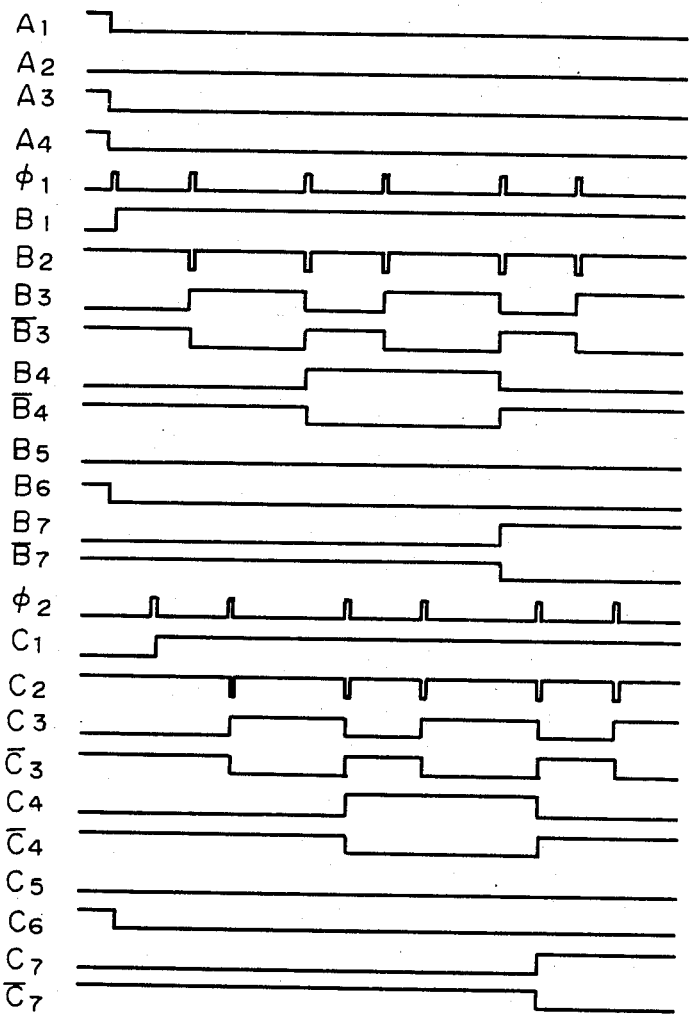

At 45 minutes after every hour, as shown in FIG. 14, the signals $A_1$, $A_2$, $A_3$, $A_4$ all fall to the L level. Consequently, in a manner similar to that described above in connection with the on-the-hour time, the flip-flops 138, 142, 144, 146 released from the reset state change the state of their output signals $B_1(C_1)$, $B_3(C_3)$, $\overline{B}_3(\overline{C}_3)$, $B_4(C_4)$, $\overline{B}_4(\overline{C}_4)$, $B_7(C_7)$, $\overline{B}_7(\overline{C}_7)$ in response to the pulse that appears in the signal $\phi_1(\phi_2)$.

Figure 15:
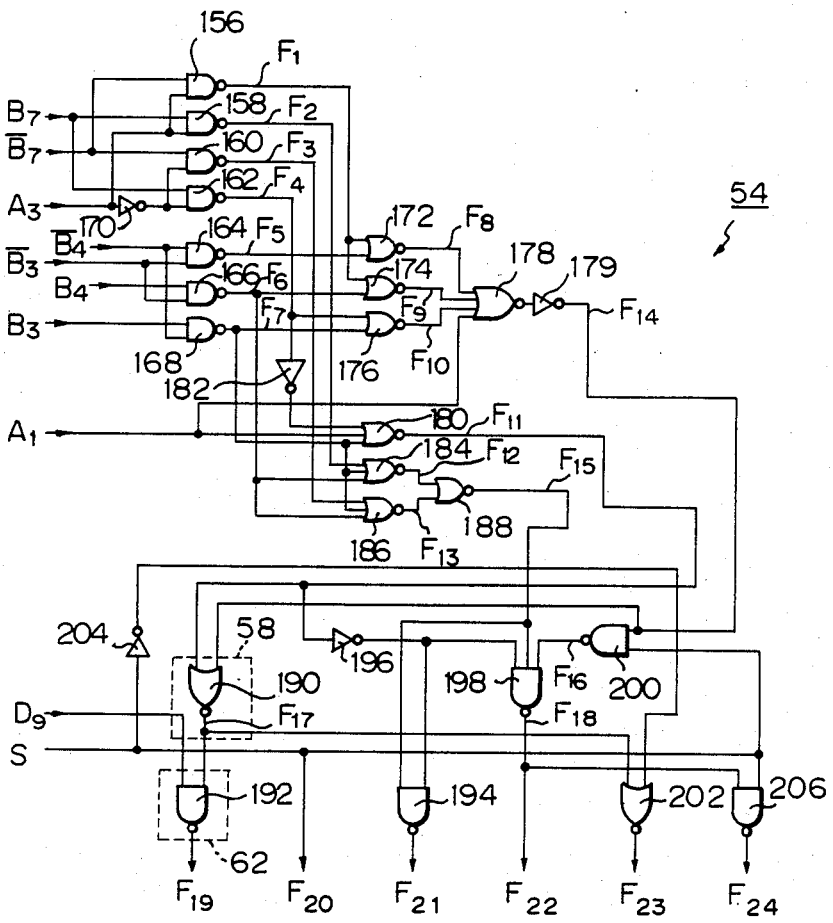
FIG. 15 is a view illustrating the detailed circuit construction of a decoder 54 shown in FIG. 1.
Figure 16:
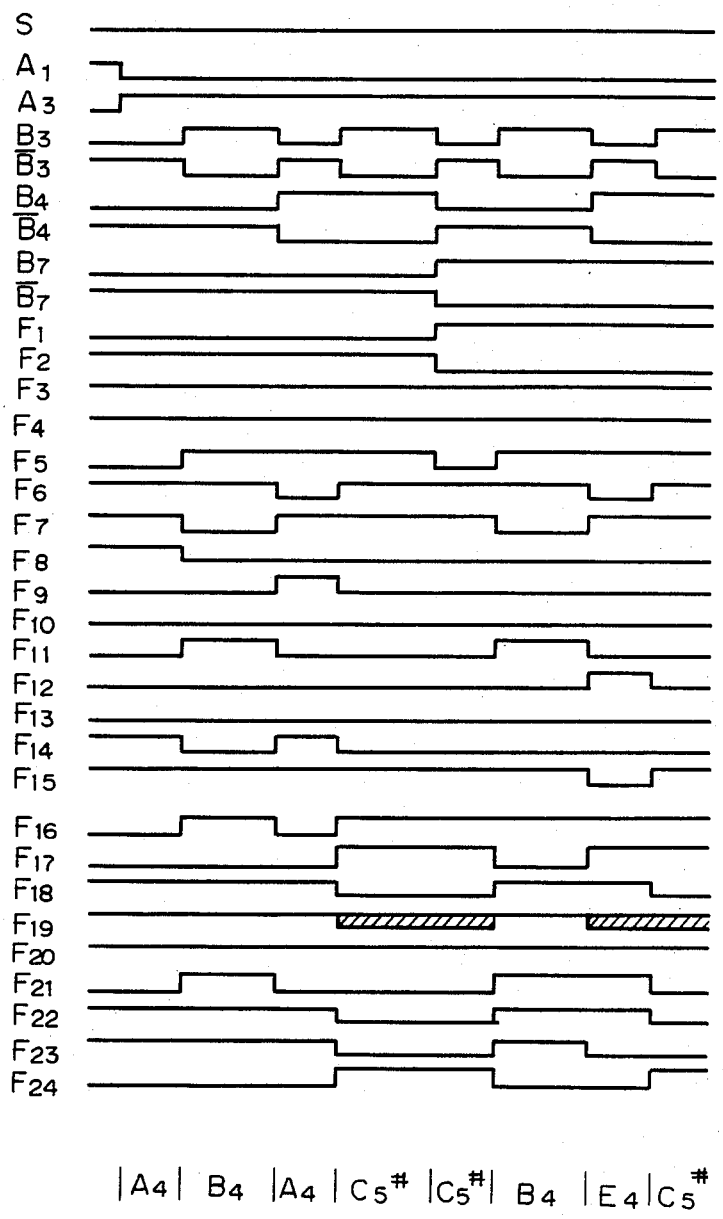
FIGS. 16 through 19 are timing charts of signals in the decoder 54 of FIG. 15 at times on the hour, 15, 30 and 45 minutes after the hour.
Figure 17:
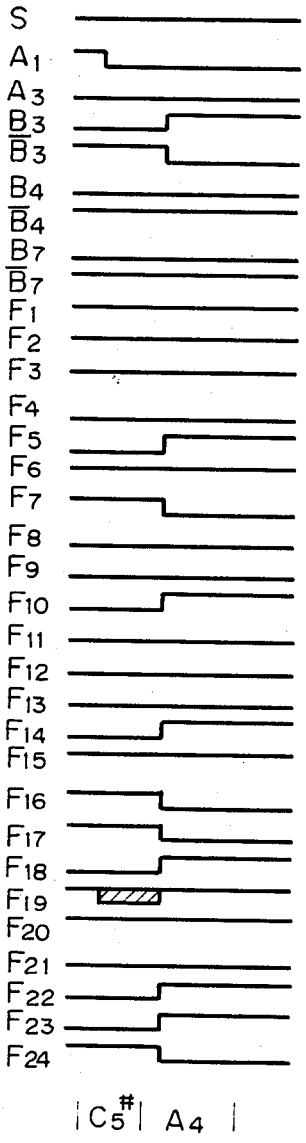
Figure 18:
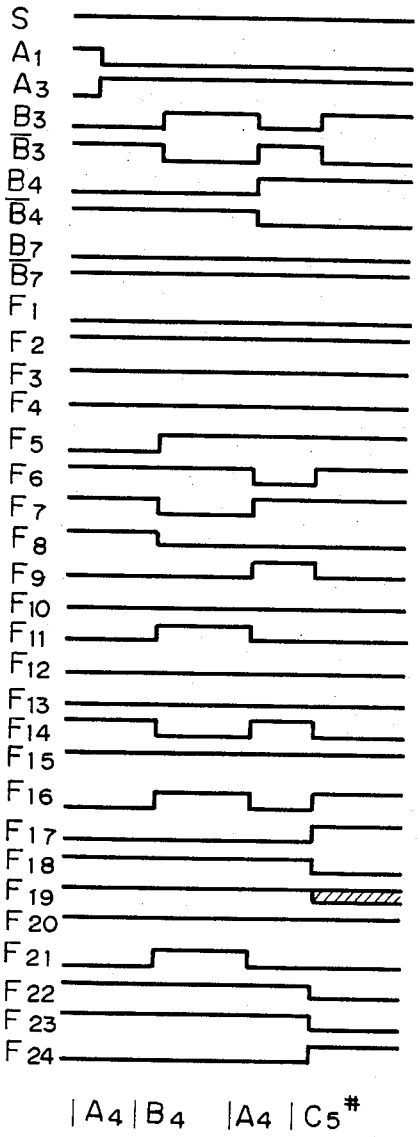
Figure 19:
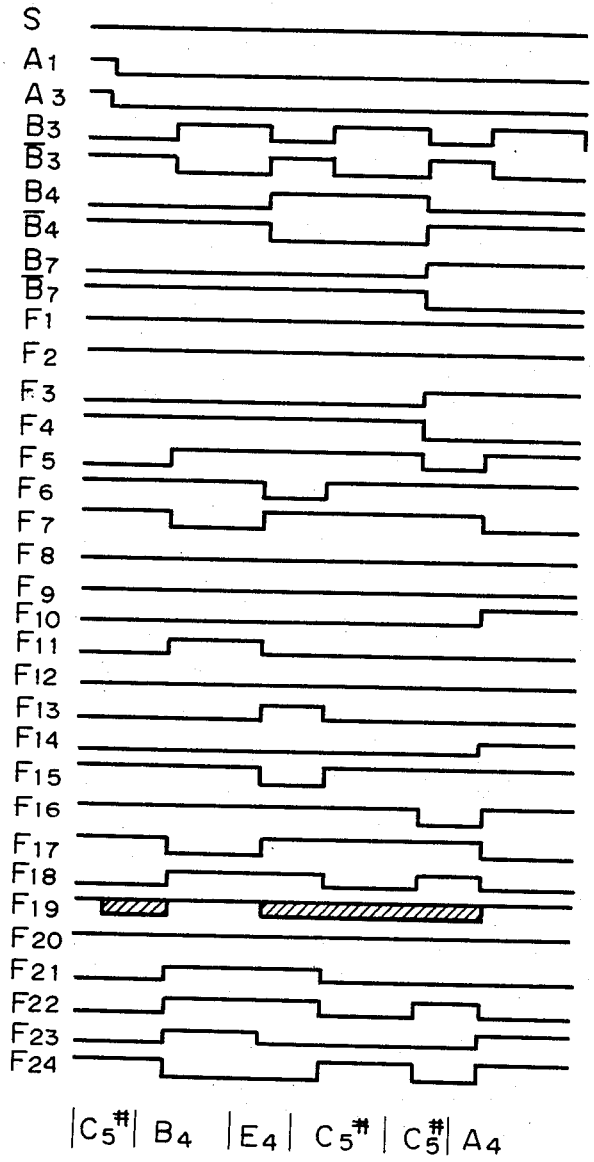

FIG. 15 is a detailed circuit diagram of the decoder 54 illustrated in FIG. 1. Numerals 156–168 denote NAND gates. The NAND gate 156 has inputs of signals $\overline{B}_7$, $A_3$, the NAND gate 158 inputs of signals $B_7$ and $A_3$, the NAND gate 160 inputs of the signal $\overline{B}_7$ and the signal $A_3$ which is inverted by an inverter 170, the NAND gate 162 inputs of the signal $B_7$ and the signal $A_3$ which is inverted by the inverter 170, the NAND gate 164 inputs of signals $\overline{B}_4$, $\overline{B}_3$, the NAND gate 166 inputs of signals $\overline{B}_3$, $B_4$, and the NAND gate 168 inputs of the signals $\overline{B}_4$, $B_3$. These NAND gates 156–168 produce output signals $F_1$–$F_7$, respectively.

Numerals 172–178 denote NOR gates. The NOR gate 172 has inputs of signals $F_1$, $F_5$, the NOR gate 174 has inputs of signals $F_1$ and $F_6$, the NOR gate 176 has inputs of signals $F_4$, $F_7$, and the NOR gate 178 inputs of signals $F_8$–$F_{10}$, which are the outputs of the respective NOR gates 172–176, as well as the signal $A_1$.

Numeral 180 denotes a NOR gate having inputs of the signal $F_4$ which is inverted by an inverter 182, the signal $A_1$ and the signal $F_7$. This NOR gate 180 produces an output signal $F_{11}$.

Numeral 184–188 represent NOR gates. The NOR gate 184 has inputs of signals $F_2$, $A_1$, $F_6$, the NOR gate 186 has inputs of signals $F_3$, $A_1$, $F_6$, and the NOR gate 188 has inputs of signals $F_{12}$, $F_{13}$, which are the output signals of NOR gates 184, 186, respectively.

The above-mentioned group of gates constitutes a section for processing the input signals to the decoder 54. The construction of the output section of decoder 54 will now be described.

Numeral 58 designates the frequency dividing ratio discriminating circuit, which comprises a NOR gate 190. The latter has inputs of the signals $F_{11}$, $F_{14}$ and produces an output signal $F_{17}$.

Numeral 62 represents the frequency dividing ratio correcting circuit, which comprises a NAND gate 192. The latter receives a signal $D_9$ from the programmable frequency divider 66 and the signal $F_{17}$, and outputs a signal $F_{19}$.

Shown at 194 is a NAND gate to which are applied a signal $F_{15}$ and the signal $F_{11}$, the latter after being inverted by an inverter 196, for outputting a signal $F_{21}$.

Numeral 198 denotes a NAND gate having inputs of a signal $F_{16}$, which is the output of a NAND gate 200 whose inputs are a signal $F_{14}$ obtained from an inverter 179 and the signal S from the change switch 45, the signal $F_{15}$, and the signal $F_{11}$ via the inverter 196. The output of the NAND gate 198 is a signal $F_{18}$.

A NOR gate 202 receives the signal S, which is first inverted by an inverter 204, and the signal $F_{17}$, and outputs a signal $F_{23}$.

A NAND gate 206 receives the signals $F_{18}$, S and outputs a signal $F_{24}$.

The output operation of decoder 54 will now be described with reference to the timing charts of FIGS. 16 through 19.

On the hour, at an 15, 30 and 45 minutes after the hour, the signals $A_1$, $A_3$ change state as depicted in FIGS. 16 through 19. At this time the output signals $B_3$, $\overline{B}_3$, $B_4$, $\overline{B}_4$, $B_7$, $\overline{B}_7$ of the address counter 50 change state, as described above. The NAND gates 156–168 and NOR gates 172–180, 184–188, which receive these signals as inputs, convert these input signals into the signals $F_{11}$, $F_{14}$, $F_{15}$, respectively, as illustrated by the time charts.

The output signal $F_{17}$ of the frequency dividing ratio discriminating circuit 58, having the signals $F_{11}$, $F_{14}$ applied thereto, is held at the L level when the scales $A_4$, $B_4$, for which the original frequency dividing ratios are even numbers, prevail. When the scales $C_5$#, $E_4$, for which the frequency dividing ratios are odd numbers, are outputted, the output signal $F_{17}$ rises from the L to the H level.

When the signal $F_{17}$ is at the L level, the output signal $F_{19}$ of the frequency dividing ratio correcting circuit 62 is held at the H level irrespective of the state of signal $D_9$, and this corrective signal is not applied to the programmable frequency divider 66. When the signal $F_{17}$ attains the H level, on the other hand, the signal $D_9$ appears in the output signal $F_{19}$, which changes state at the periods of the signal $D_9$. Among the signals $F_{24}$–$F_{19}$ applied to the programmable frequency divider 66, only the signal $F_{19}$ repeatedly changes state. Consequently, the transition from "1" to "0" of the signal $F_{19}$, which indicates the end of the frequency dividing ratio data (the binary complement of the frequency dividing ratio), is repeated and the corrective signal, which subtracts one from the frequency dividing ratio data and increases the frequency dividing ratio by one, is applied to the programmable frequency divider 66.

The change in the frequency dividing ratio at this time will be described below.

Figure 20:
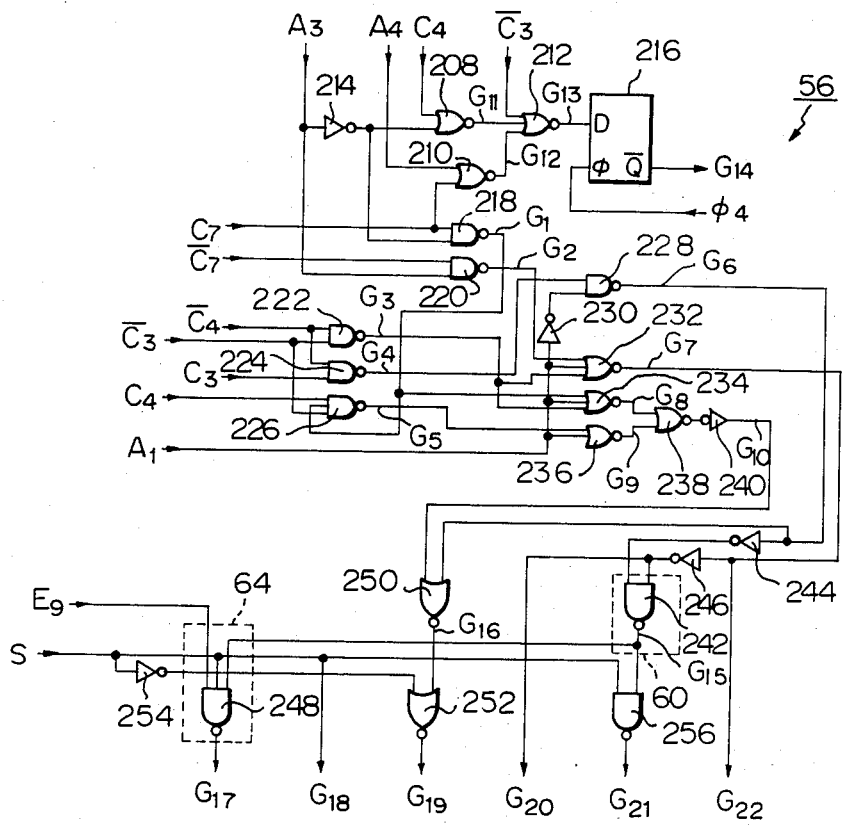
FIG. 20 is a view illustrating the detailed circuit construction of a decoder 56 shown in FIG. 1.
Figure 21:
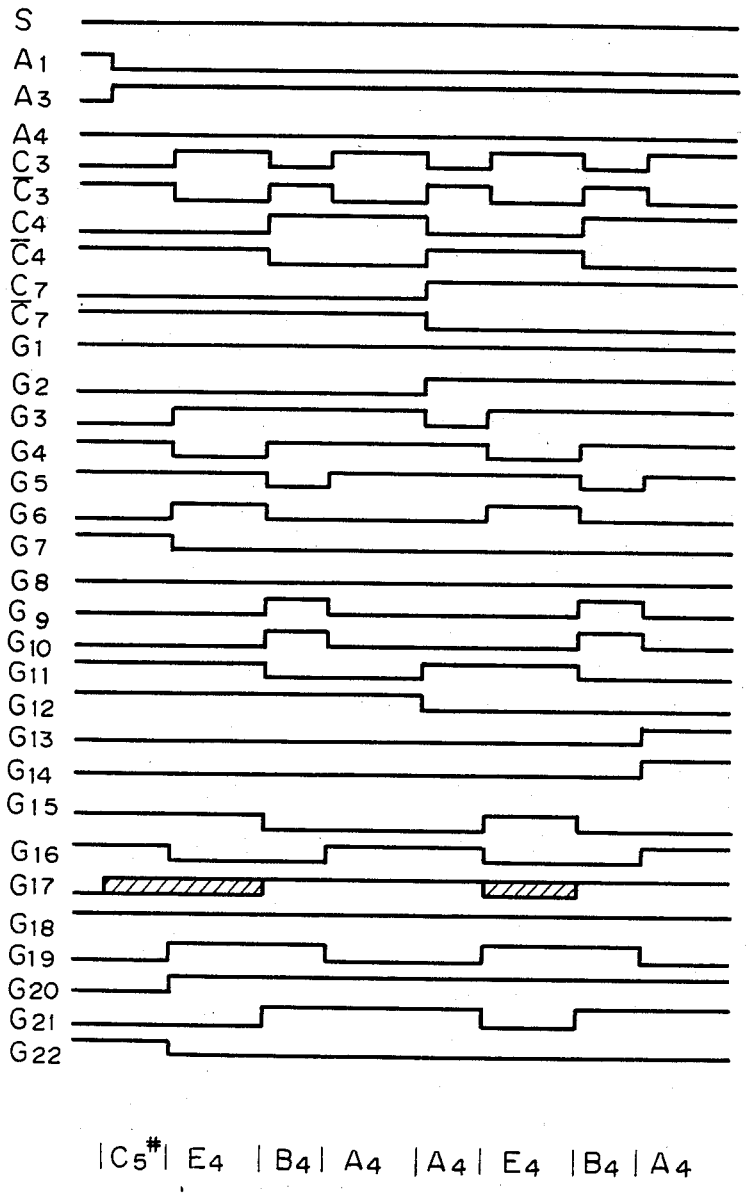
FIGS. 21 through 24 are timing charts of signals in the decoder 56 of FIG. 20 at times on the hour, 15, 30 and 45 minutes after the hour.
Figure 22:
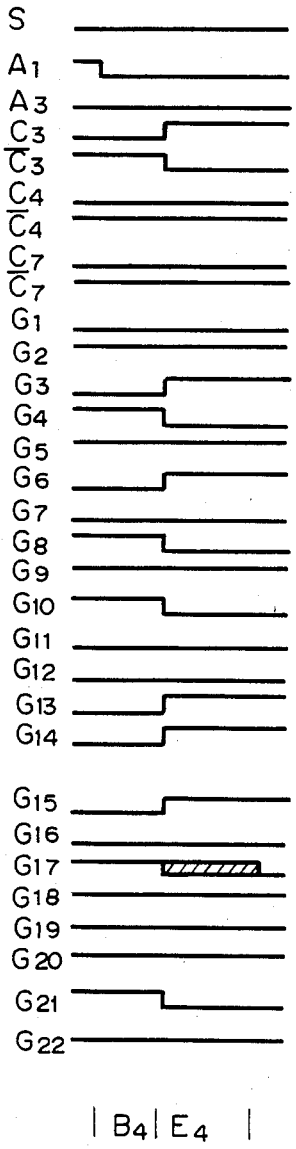
Figure 23:
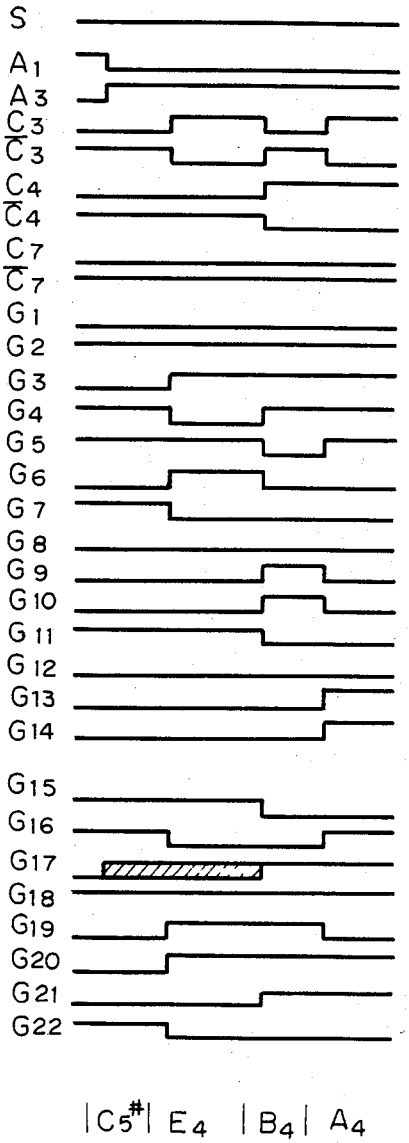
Figure 24:
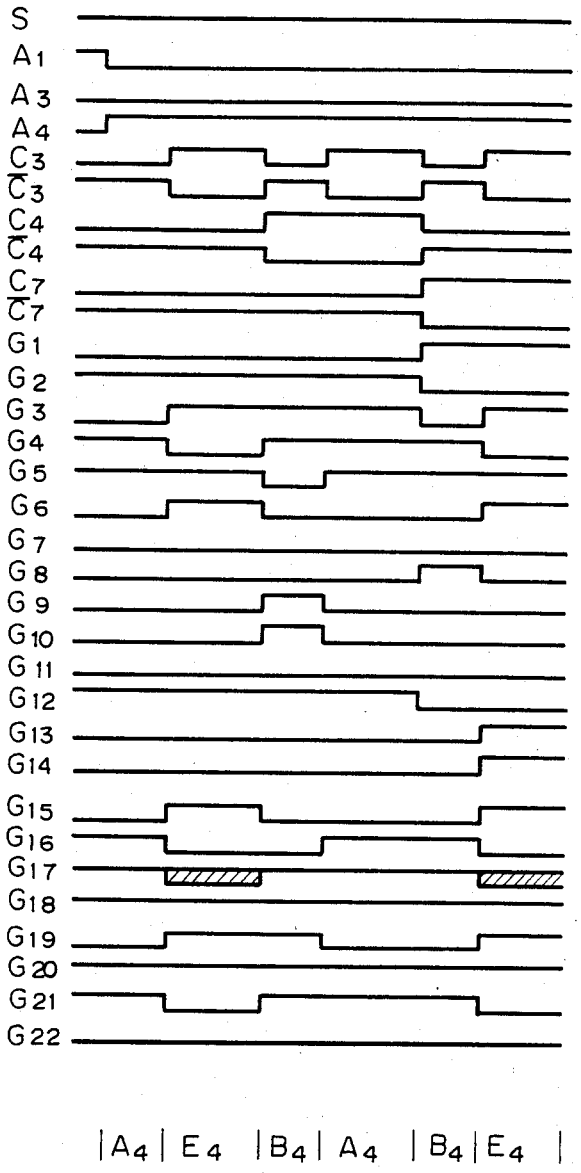

FIG. 20 is a detailed circuit diagram of the decoder 56 shown in FIG. 1.

Numerals 208–212 denote NOR gates. The NOR gate 208 has inputs of signals $C_4$ and $A_3$, the latter after being inverted by an inverter 214, the NOR gate 210 has inputs of signals $A_4$ and $C_7$, and the NAND gate 212 has inputs of signals $G_{11}$, $G_{12}$, which are the outputs of the respective NOR gates 208, 210, and the signal $\overline{C}_3$ for outputting a signal $G_{13}$, which indicates that the final tone of a melody has generated.

Numeral 216 represents a flip-flop having a input D, to which the signal $G_{13}$ is applied, and an output $\overline{Q}$ that provides a signal $G_{14}$ indicating the end of a melody time tone.

Shown at 218, 220 are NAND gates. The NAND gate 218 receives the signal $C_7$ and the signal $A_3$ via the inverter 214, and the NAND gate 220 receives the signals $\overline{C}_7$, $A_3$. These NAND gates 218, 220 produce outputs $G_1$, $G_2$, respectively.

Numerals 222–228 denote NAND gates. The NAND gate 222 has inputs of signals $\overline{C}_4$, $\overline{C}_3$, the NAND gate 224 has inputs of signals $\overline{C}_4$ and $C_3$, the NAND gate 226 has inputs of signals $C_4$, $\overline{C}_3$, $G_1$, and the NAND gate 228 has inputs of the $G_4$ and the signal $A_1$ which is first inverted by an inverter 170. These NAND gates 222–228 produce output signals $G_3$–$G_6$, respectively.

Numerals 232–238 denote NOR gates. The NOR gate 232 has inputs of signals $G_2$, $A_1$, $G_3$, the NOR gate 234 has inputs of signals $G_1$, $G_3$, $A_1$, and the NOR gate 236 has inputs of signals $G_5$, $A_1$. These NOR gates 232, 234, 236 output signals $G_7$, $G_8$, $G_9$, respectively. The NOR gate 238 has inputs of signals $G_8$, $G_9$ and outputs a signal $G_{10}$ via an inverter 240.

The above-mentioned group of gates 218–228, 232–238 constitutes a section for processing the input signals to the decoder 56. The construction of the output section of decoder 56 will now be described.

Numeral 60 designates the frequency dividing ratio discriminating circuit, which comprises a NAND gate 242. The latter has inputs of the signals $G_6$, $G_7$, received via respective inverters 244, 246, and produces an output signal $G_{15}$.

Numeral 64 represents the frequency dividing ratio correcting circuit, which comprises a NAND gate 248. The latter receives the signal $G_{15}$, a signal $E_9$ from the programmable frequency divider 66, and the signal S from the change switch 45, and outputs a signal $G_{17}$.

Numerals 250, 252 designate NOR gates. The NOR gate 250 receives the signals $G_{10}$, $G_6$ and outputs a signal $G_{16}$, and the NOR gate 252 receives the signal $G_{16}$ and the signal S, which arrives via an inverter 254, and outputs a signal $G_{19}$.

Numeral 256 denotes a NAND gate which receives the signals $G_{15}$, S and outputs a signal $G_{21}$.

The output operation of the decoder 56 will now be described with reference to the time charts of FIGS. 21 through 24.

On the hour, at an 15, 30 and 45 minutes after the hour, the signals $A_1$, $A_3$, $A_4$, and the output signals $C_3$, $\overline{C}_3$, $C_4$, $\overline{C}_4$, $C_7$, $\overline{C}_7$ of the address counter successively change state, as described above.

These signals from the address counter 52 are successively converted by the group of gates 218–228, 232–238 and are outputted as signals $G_6$, $G_7$, $G_{10}$.

The output signal $G_{15}$ of the frequency dividing ratio discriminating circuit 60, to which the signals $G_6$, $G_7$ are applied via the respective inverters 244, 246, falls to the L level when the scales $B_4$, $A_4$, for which the frequency dividing ratios originally are even numbers, are outputted, and rises to the H level when the scales $C_5$#, $E_4$, for which the frequency dividing rations originally are odd numbers, are outputted.

When the signal $G_{15}$ is at the L level, the output signal $G_{17}$ of the frequency dividing ratio correcting circuit 64 is held at the H level irrespective of the other signals applied to the circuit 64.

When the signal $G_{15}$ is at the H level, on the other hand, the signal $E_9$ appears in the output signal $G_{17}$ of the frequency dividing ratio correcting circuit 64. At this time, the transition from "1" to "0" of the end of the frequency dividing ratio data is repeated and the signal $G_{17}$ becomes the corrective signal, which subtracts one from the frequency dividing ratio data (the complement of the frequency dividing ratio) and increases the frequency dividing ratio by one, in a manner similar to that described above in connection with the decoder 54. The change in the frequency dividing ratio at this time will be described below.

Figure 25:
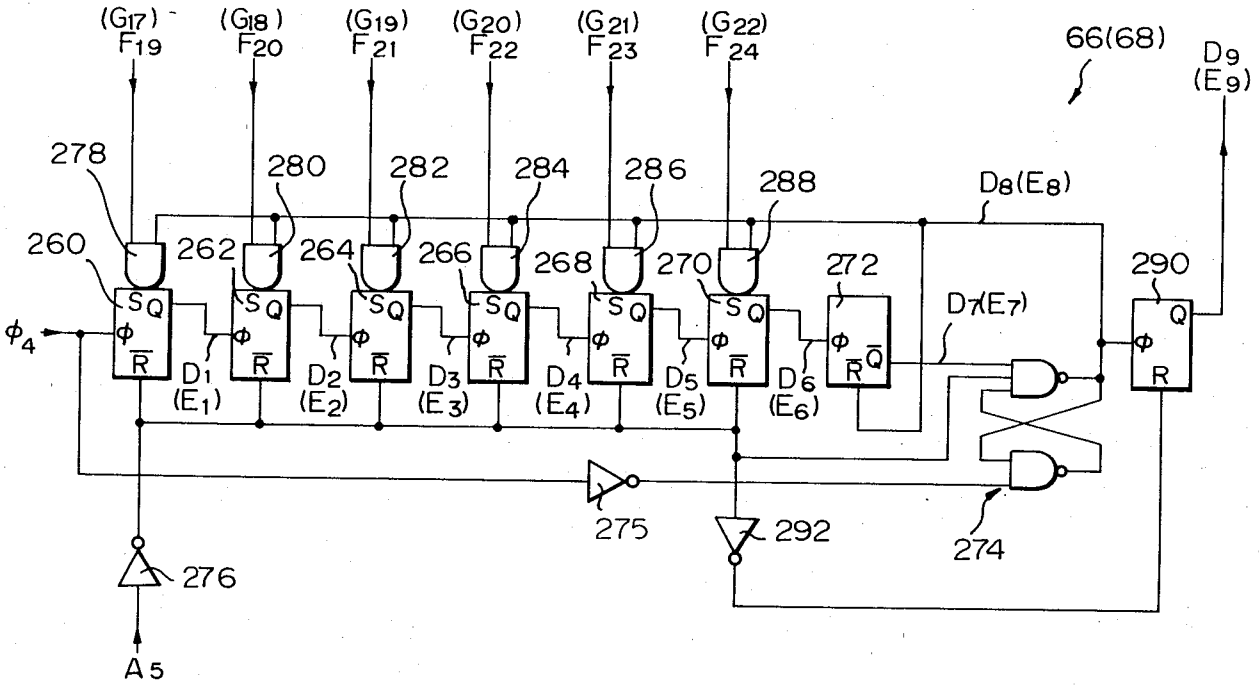
FIG. 25 is a view illustrating the detailed circuit construction of programmable frequency dividers 66, 68 shown in FIG. 1.

FIG. 25 is a detailed circuit diagram of the programmable frequency divider 66 shown in FIG. 1. Since the programmable frequency divider 68 is structurally identical with the programmable frequency divider 66, only its input and output signals are indicated, these being enclosed by parentheses.

Numerals 260–272 represent flip-flops constructing a counter for frequency-dividing an input clock signal $\phi_4$ by 64.

Numeral 274 designates a flip-flop which receives an output signal $D_7(E_7)$ from the flip-flop 272, the signal $A_5$ inverted by an inverter 276 and the clock signal $\phi_4$ inverted by an inverter 275, and which produces a pulse in its output signal $D_8(E_8)$ when frequency division at a present frequency dividing ratio ends.

Numerals 278–288 denote AND gates which respectively receive the signals $F_{19}$–$F_{24}(G_{17}$–$G_{22})$ at one input terminal and the signal $D_8(E_8)$ at the other input terminal. When a pulse appears in the signal $D_8(E_8)$, these AND gates are opened to apply the frequency dividing ratio data signals $F_{19}$–$F_{24}(G_{17}$–$G_{22})$ from the decoder 54 (56) to the set input S of the corresponding flip-flops 260–270.

Indicated at 290 is a ½ frequency divider comprising a flip-flop having a reset input R receiving the signal $A_5$ via inverters 276, 292, and a clock input $\phi$ receiving the signal $D_8(E_8)$, for outputting a signal $D_9(E_9)$.

The operation of the above programmable frequency dividers 66, 68 will now be described with reference to the timing charts of FIGS. 26 through 33.

Figure 26:
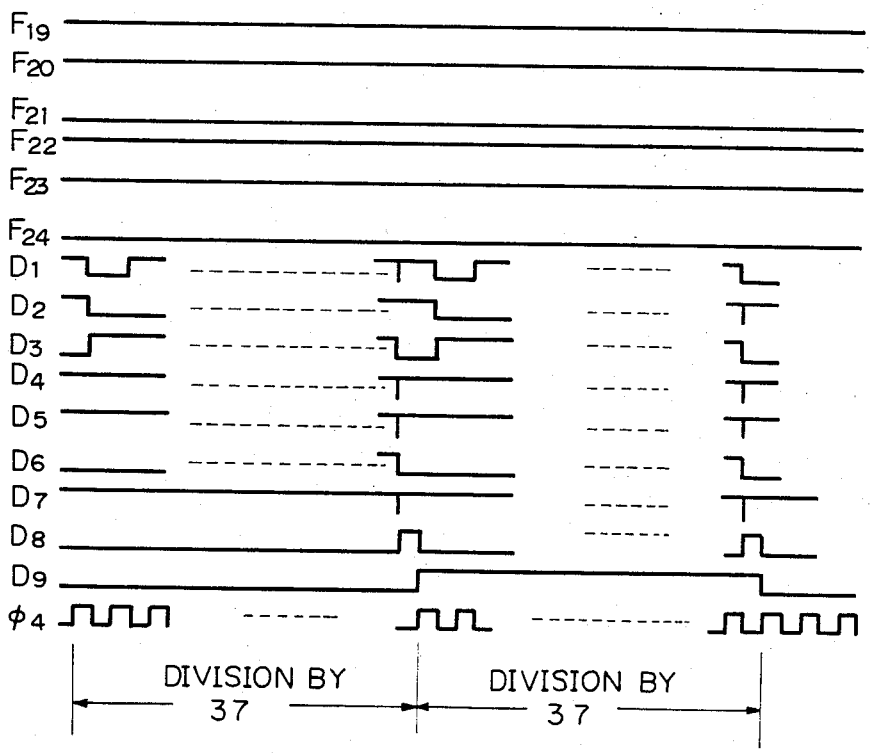
FIGS. 26 through 29 are timing charts of signals in the programmable frequency divider 66 of FIG. 25 when outputting musical scales $A_4$, $B_4$, $C_5$# and $E_4$.
Figure 30:
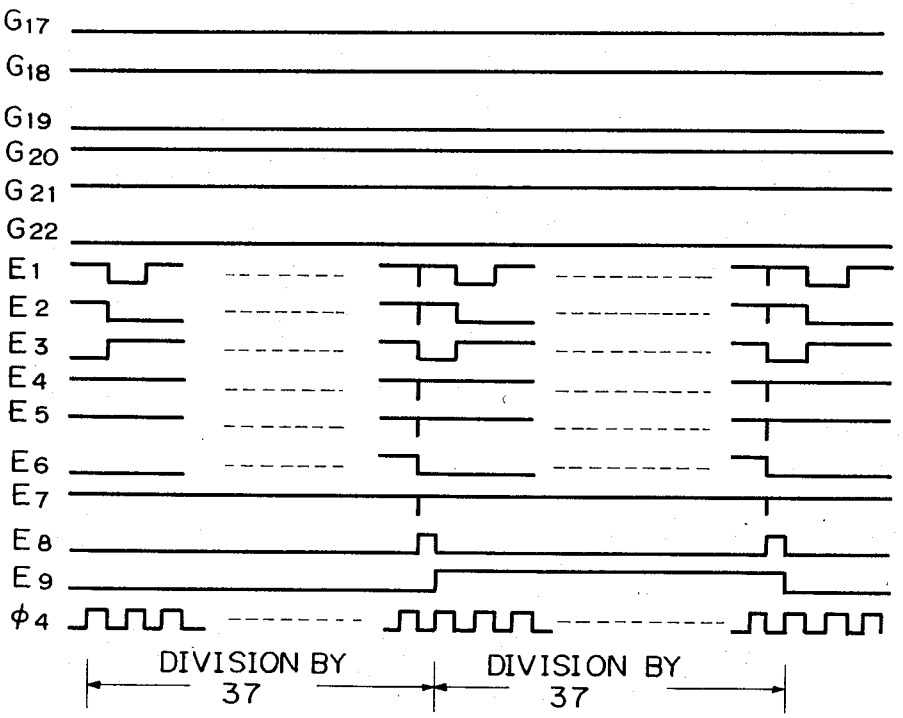
FIGS. 30 through 33 are timaing charts of signals in the programmable frequency divider 68 of FIG. 25 when outputting musical scales $A_4$, $B_4$, $C_5$# and $E_4$.

First, let us describe a frequency dividing operation for outputting the scale $A_4$ based on FIG. 26 (timing chart for programmable frequency divider 66) and FIG. 30 (timing chart for programmable frequency divider 68).

In order to obtain the scale frequency of scale $A_4$, frequency division by 74 is originally required. In the illustrated embodiment, the flip-flops 260–272 effect division by 37, and the ½ frequency divider 290 further divides the result by two, thereby providing the signal $D_9(E_9)$ which is the result of division by 74.

The output signals $F_{19}$–$F_{24}$ $(G_{17}$–$G_{22})$ of address counter 50 (52) in the case where scale $A_4$ is to be obtained are at levels H, H, L, H, H, L, respectively, thus indicating "27" in the form of a binary number. When the flip-flops 260–270 are set to "27" by the signals $F_{19}$–$F_{24}(G_{17}$–$G_{22})$, these flip-flops begin counting from "28" and count up to "64", whereupon a pulse appears in the signal $D_7(E_7)$. When this pulse is generated, a pulse is also produced in the output signal $D_8(E_8)$ of flip-flop 274. The output Q of the ½ frequency divider 290 attains the H level in synchronism with the negative-going transition of the pulse produced in the signal $D_8(E_8)$.

Further, when the pulse is produced in the signal $D_8(E_8)$, the AND gates 278–288 open again and the frequency dividing ratio data signals $F_{19}$–$F_{24}(G_{17}$–$G_{22})$ for frequency division by 37 are applied to the respective flip-flops 260–270. The above-described operation is repeated, a pulse is again produced in the saignal $D_8(E_8)$, and the output of the ½ frequency divider 290 is set to the L level in synchronism with the negative-going transition of this pulse.

As a result, the signal $D_9(E_9)$, resulting from division by 74 and having a duty cycle of 50%, can be obtained.

Figure 27:
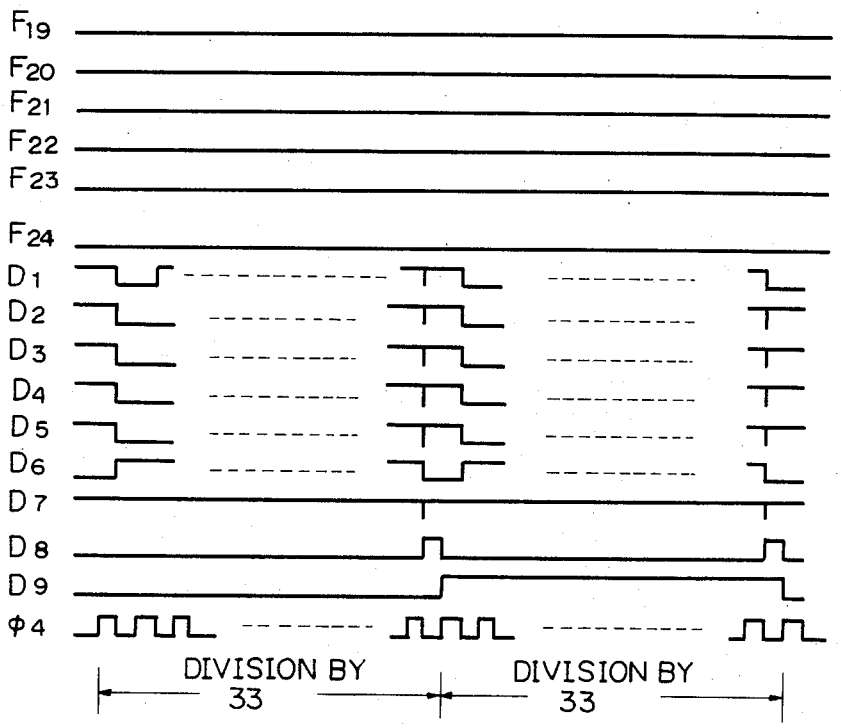
Figure 31:
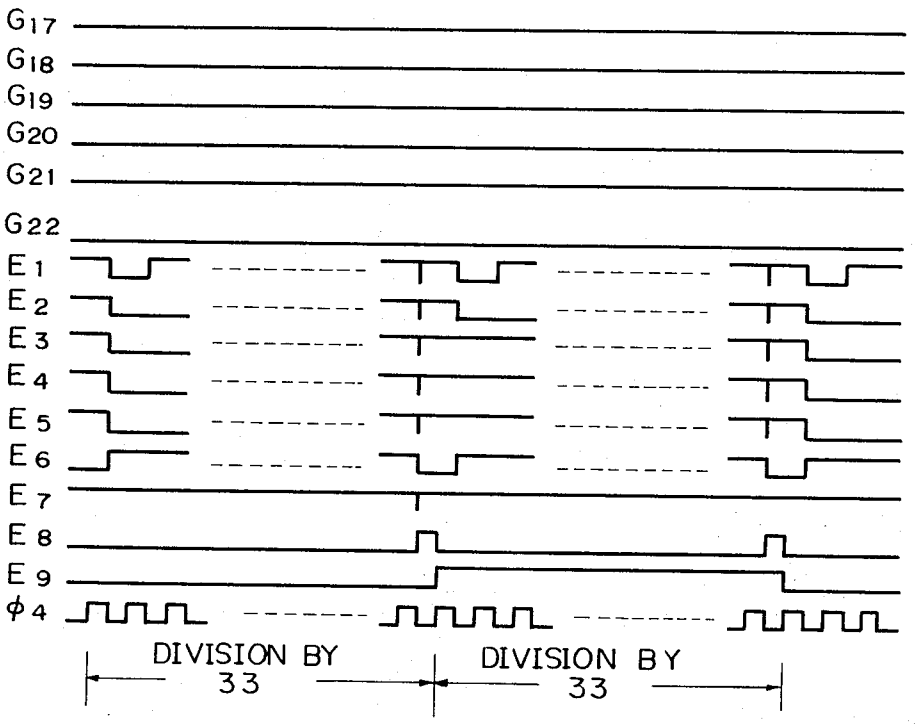
Figure 32:
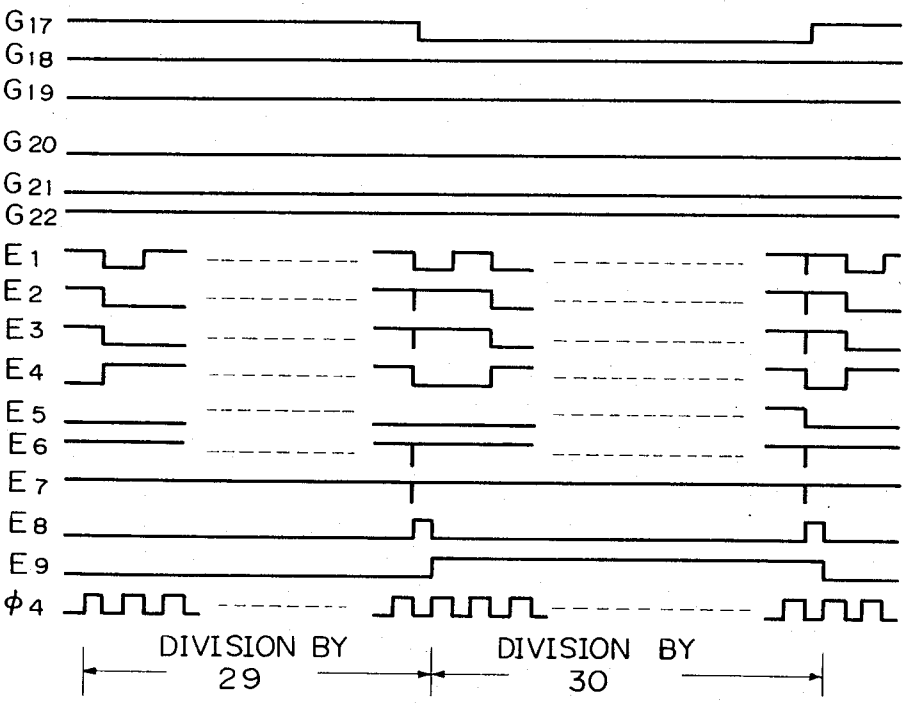
Figure 33:
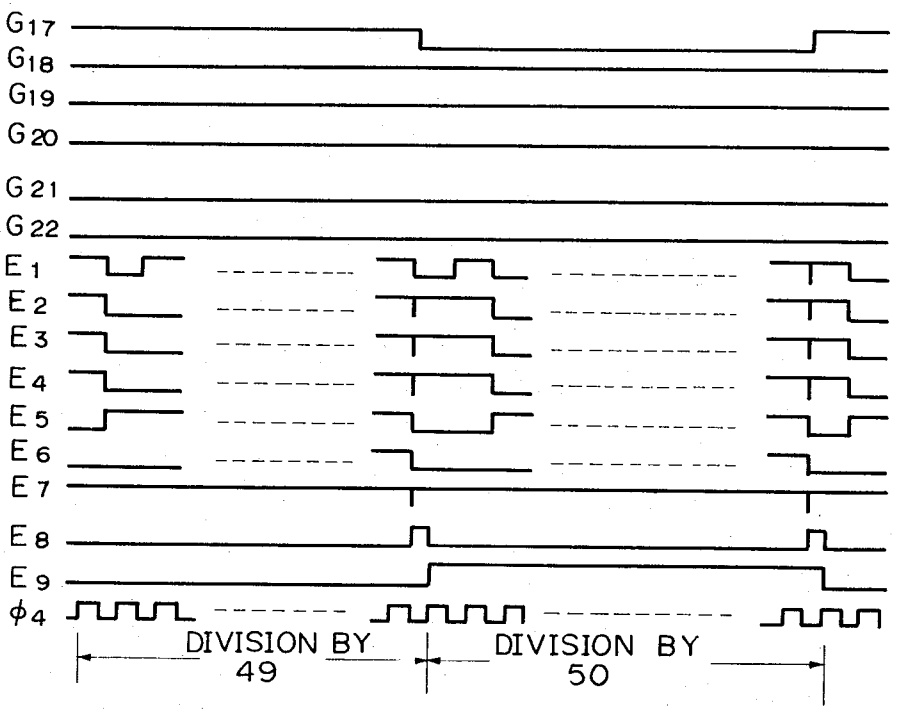

Though the scale $B_4$ is obtained in the same manner as the scale $A_4$ described above, the states of the signals $F_{19}$–$F_{24}$ $(G_{17}$–$G_{22})$ from the decoder 54 (56) differ, as illustrated in FIG. 27 (timing chart for the programmable frequency divider 66) and FIG. 31 (timing chart for the programmable frequency divider 68). Spcifically, in order to obtain the scale $B_4$, division by 66 is originally required. In the illustrated embodiment, division by 33 is required using the flip-flops 260–272. Accordingly, the signals $F_{19}$–$F_{24}(G_{17}$–$G_{22})$ attain levels H, H, H, H, H, L, respectively, which is a state indicating "31" in the form of a binary number. When the flip-flops 260–270 are set to "31", these flip-flops being counting from "32" and count up to "64", whereupon a pulse appears in the signal $D_7(E_7)$. As a result, the output $D_9(E_9)$ of the ½ frequency divider 290 is a signal obtained through division by 66.

Figure 28:
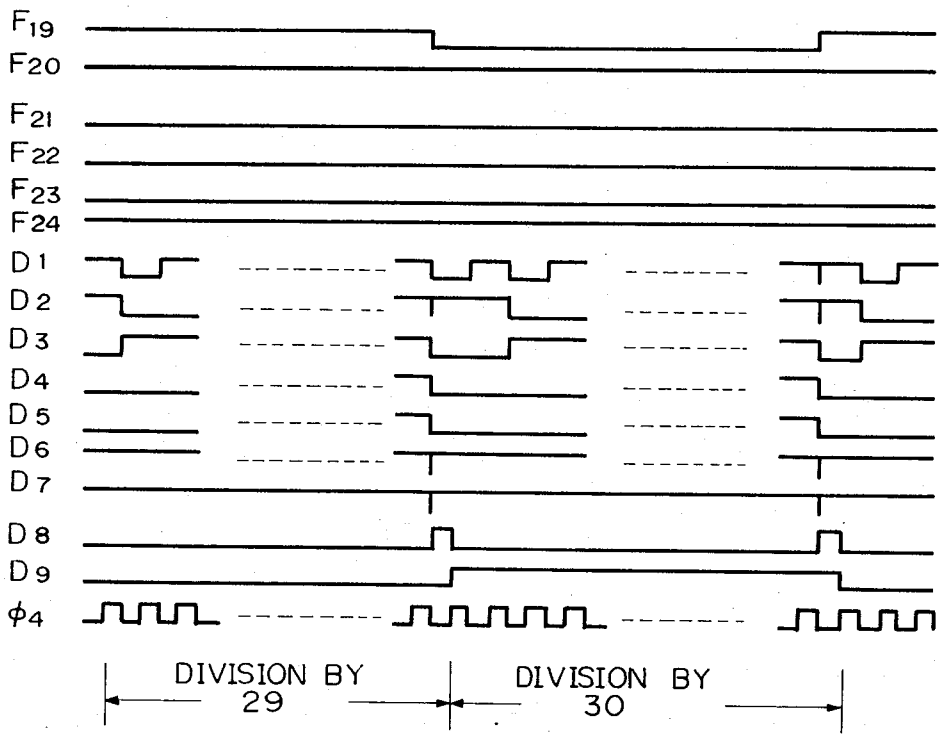

In a case where scale $C_5$# is obtained, division by 59 is originally required. In the illustrated embodiment, the arrangement is such that division by 29 is performed first, followed by correction of the frequency dividing ratio and division by 30, to effect division by 59 overall. In other words, as shown in FIG. 28 (timing chart for programmable frequency divider 66) and FIG. 32 (timing chart for programmable frequency divider 68), first the output signals $F_{19}$–$F_{24}(G_{17}$–$G_{22})$ of the decoder 54 (56) attain the respective levels H, H, L, L, L, H, which represents "35" in binary notation. Consequently, the flip-flops 260–270 are set to "35" and begin counting from "36", up to "64", whereupon a pulse appears in the output signal $D_7(E_7)$ of flip-flop 272. When this pulse is generated, a pulse is also produced in the output signal $D_8(E_8)$ of flip-flop 274 and the output signal $D_9(E_9)$ of the ½ frequency divider 290 attains the H level in synchronism with the negative-going transition of the pulse produced in the signal $D_8(E_8)$, as described above.

When the signal $D_9(E_9)$ attains the H level, the frequency dividing ratio correcting circuit 62 (64) shown in FIGS. 15 and 20 is responsive to the signal $D_9(E_9)$ and changes the output signal $F_{19}(G_{17})$ to the L level, as mentioned above.

Consequently, when the signal $F_{19}(G_{17})$ representing the end of the frequency dividing ratio data falls to the L level, the signals $F_{19}$–$F_{24}(G_{17}$–$G_{22})$ attain a state indicative of "34", and the flip-flops 260–270 are set to "34" and begin counting from "35", up to "64". When these flip-flops count up to 64, a pulse appears in the output signal $D_7(E_7)$ of flip-flop 272 and in the output signal $D_8(E_8)$ of flip-flop 274. The output signal $D_9(E_9)$ of the ½ frequency divider 290 falls to the L level and the signal $F_{19}(G_{17})$ rises to the H level.

As a result, in the initial L-level portion of the output signal $D_9(E_9)$ of ½ frequency divider 290, the flip-flops 260–270 are preset to "35", so that the clock signal $\phi_4$ is frequency-divided by 29. In the next H-level portion of the signal $D_9(E_9)$, the frequency dividing ratio is corrected and the flip-flops 260–270 are preset to "34", so that the clock pulse $\phi_4$ is frequency-divided by 30. Accordingly, the signal $D_9(E_9)$ is a signal resulting from division by 59 overall, and the duty cycle of this signal also is approximately 50%.

Figure 29:
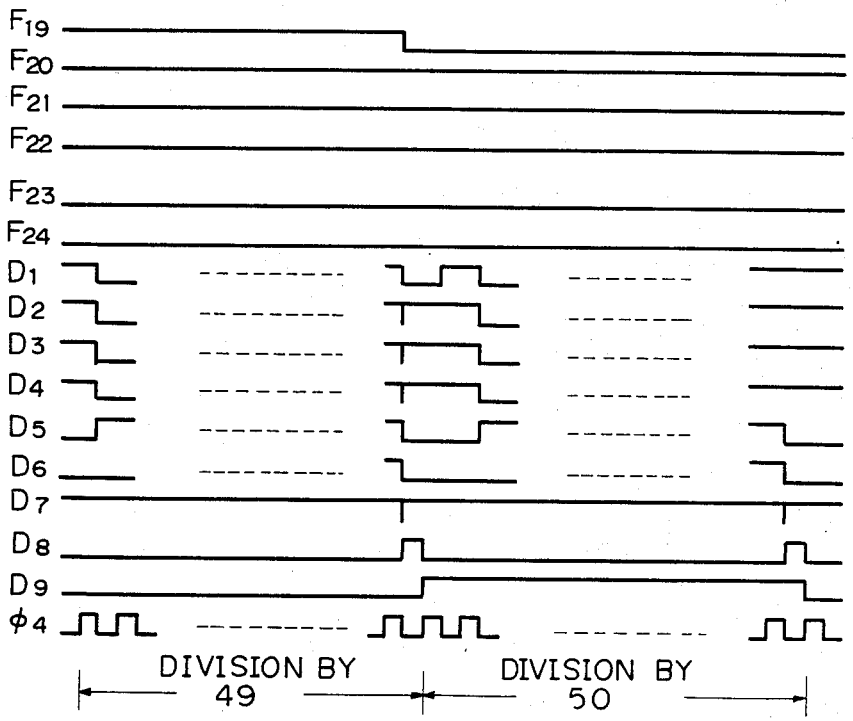

In a case where the scale $E_4$ is obtained, odd-numbered frequency division (i.e. by 99) is required, the same as for scale $C_5$# mentioned above. In the illustrated embodiment, as shown in FIG. 29 (timing chart for programmable frequency divider 66) and FIG. 33 (timing chart for programmable frequency divider 68), first the signals $F_{19}$–$F_{24}(G_{17}$–$G_{22})$ attain the state representing "15". The flip-flops 260–270 are set to "15" and count from "16", up to "64". Then, just as in the case for scale $C_5$#, a pulse appears in the signal $D_8(E_8)$ and the output signal $D_9(E_9)$ of the ½ frequency divider 290 attains the H level, whereupon the signal $F_{19}(G_{17})$ falls to the L level and the flip-flops 260–270 are preset to "14". Now these flip-flops count from "15" to "64". When a pulse appears in the signal $D_8(E_8)$, the output signal $D_9(E_9)$ of the ½ frequency divider 290 falls to the L level and the signal $F_{19}(G_{17})$ rises to the H level.

As a result, in the initial L-level portion of the output signal $D_9(E_9)$ of ½ frequency divider 290, the clock signal $\phi_4$ is frequency-divided by 49. In the next H-level portion, the clock pulse $\phi_4$ is frequency-divided by 50. Accordingly, the signal $D_9(E_9)$ is a signal resulting from division by 99 overall, and the duty cycle of this signal is approximately 50%.

Figure 34:
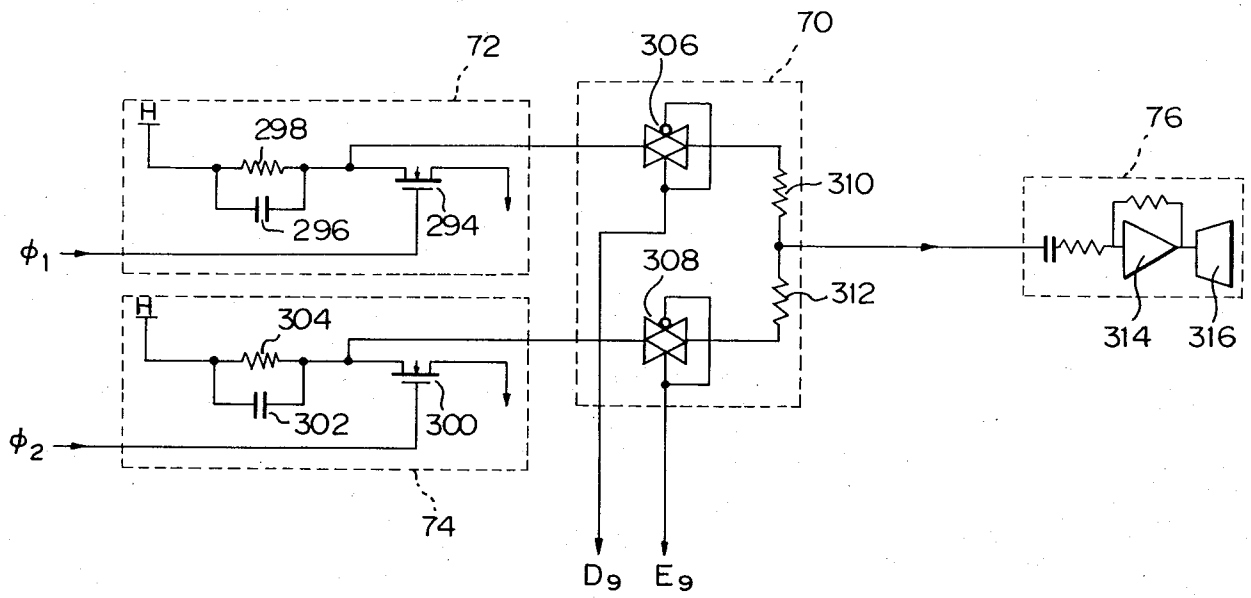
FIG. 34 is a view illustrating the detailed circuit constructions of envelope circuits, mixer and tone generating circuit shown in FIG. 1.
Figure 35:
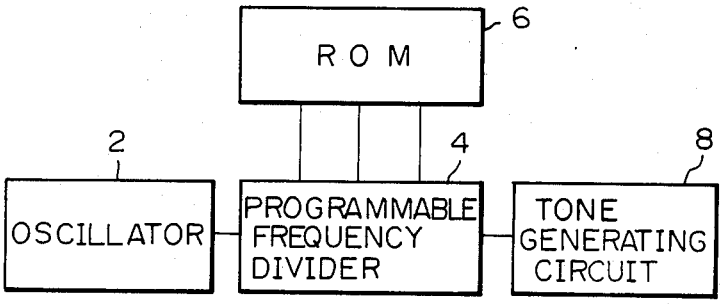
FIG. 35 is a schematic view of a conventional scale generating device.
Figure 36:
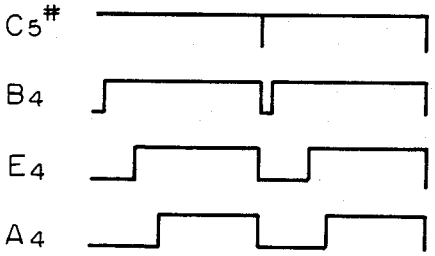
FIG. 36 is a timing chart of scale frequency signals obtained with the conventional device.
Figure 37:
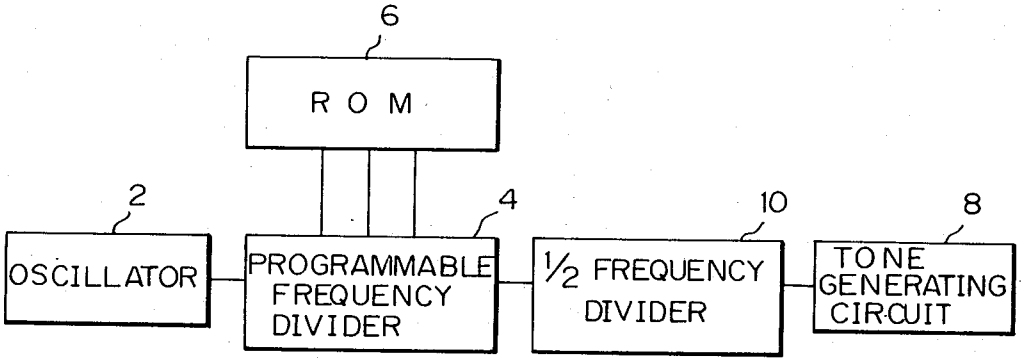
FIG. 37 is a view illustrating an example of a device for solving the problem of the prior art.
Figure 38:
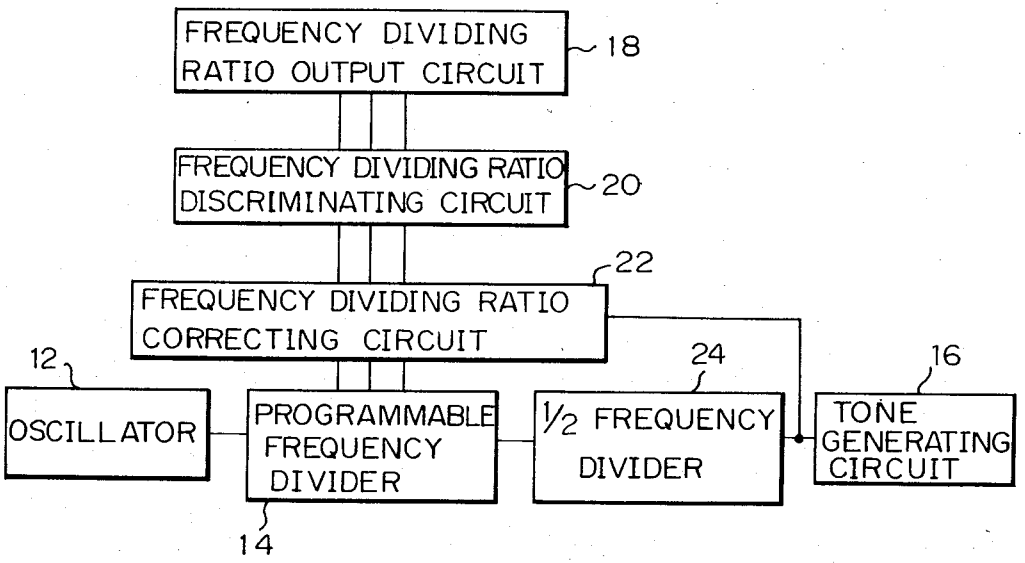
FIG. 38 is a view illustrating the basic construction of the present invention.

Referring now to FIG. 34, the envelope circuit 72 comprises N-channel transistor 294 having a gate terminal receiving the signal $\phi_1$, and a condenser 296 and resistance 298 connected to each other in parallel. Further, the envelope circuit 74 comprises N-channel transistor 300 having a gate terminal receiving the signal $\phi_2$, and a condenser 302 and resistance 304 connected to each other in parallel. The N-channel transistors 294, 300 go to the conductive state by receiving the H-level signals $\phi_1$, $\phi_2$, respectively, whereby the condensers 296, 302 are charged. Then, the N-channel transistors 294, 300 go to the non-conductive state in response to the fall of the signals $\phi_1$, $\phi_2$, and the condensers 296, 302 gradually discharges.

The mixer 70 comprises transmission gates 306, 308, and resistances 310, 312, respectively. The transmission gate 306 receives the envelope signal from the envelope circuit 72 and the signal $D_9$ from the programmable frequency divider 66 and transmits this envelope signal in accordance with the timing of the signal $D_9$. The transmission gate 308 receives the envelope signal from the envelope circuit 74 and the signal $E_9$ from the programmable frequency divider 68 and transmits this envelope signal in accordance with the timing of the signal $E_9$. The output signals of the transmission gates 306, 308 are applied to the tone generating circuit 76 through the resistances 310, 312, respectively.

The tone generating circuit 76 comprising an amplifier circuit 314 and a speaker 316 generates a sound in response to the output signal of the mixer 70.

According to the present invention, a duty cycle of 50% can be achieved when obtaining a scale frequency signal of a desired scale. This makes it possible to generate a tone of superior quality.

In addition, a high-frequency source of oscillation is not necessary, even though the invention uses the ½ frequency divider. This makes it possible to reduce cost and power consumption.

I claim:

1. A musical scale generating circuit comprising:

a oscillator circuit for providing a clock signal;

a programmable frequency divider for dividing said clock signal;

a frequency dividing ratio data output circuit for providing frequency dividing ratio data determinative of a plurality of frequency dividing ratios of said programmable frequency divider;

a frequency dividing ratio discriminating circuit responsive to an output signal from said frequency dividing ratio data output circuit for detecting whether a frequency dividing ratio for providing desired scale frequency is an odd number and providing an output signal;

a frequency dividing ratio correcting circuit responsive to said output signal from said frequency dividing ratio discriminating circuit for correcting said frequency dividing ratio by one of incrementing and decrementing when an odd-number frequency is detected by said frequency dividing ratio discriminating circuit and applying a signal corresponding to said corrected dividing ratio to said programmable frequency divider to set the dividing ratio;

a one-half frequency divider for dividing an output signal from said programmable frequency divider by two; and a tone generating circuit for generating a tone in response to an output signal from said programmable frequency divider.

2. A musical scale generating circuit according to claim 1, wherein said frequency dividing ratio output circuit is so set as to output data indicative of a frequency dividing ratio nearest to one-half a frequency dividing ratio necessary for outputting a desired scale frequency.

3. A musical scale generating circuit according to claim 2, wherein said frequency dividing ratio being provided from said frequency dividing ratio output circuit is a binary number signal, and wherein said frequency dividing ratio correcting circuit corrects the lowest figure of the binary number signal.

4. A musical scale generating circuit according to claim 1, wherein said frequency dividing ratio output circuit comprises an address counter and a decoder responsive to an output signal from said address counter for providing said frequency dividing ratio in predetermined order.

5. In an electronic timepiece having an oscillator and a frequency divider circuit for dividing an output signal from said oscillator, the improvement comprising:

a time tone control circuit providing a note length signal and time discriminating signal when discriminating predetermined time;

a frequency dividing ratio data output circuit responsive to said note length signal and time discriminating signal for providing a dividing ratio signal;

a frequency dividing ratio discriminating circuit responsive to said dividing ratio signal for detecting whether a frequency dividing ratio for providing desired scale frequency is an odd number and providing an output signal;

a frequency dividing ratio correcting circuit responsive to said output signal from said frequency dividing ratio discriminating circuit for correcting said dividing ratio signal by one of incrementing and decrementing when an odd-number frequency is detected by said frequency dividing ratio discriminating circuit and providing a corrected signal corresponding to said corrected dividing ratio;

a programmable frequency divider responsive to said corrected signal for dividing said clock signal by the dividing ratio being indicated by said corrected signal;

an envelope circuit responsive to said note length signal for providing a envelope signal;

a mixer for mixing said envelope signal and an output signal of said programmable divider circuit; and a tone generating circuit generating a time tone in response to an output signal of said mixer.

6. The improvement according to claim 5, wherein said frequency dividing ratio output circuit comprises an address counter for providing a code signal and a decoder responsive to said code signal for providing said frequency dividing ratio in predetermined order.

7. The improvement according to claim 5, further comprising a 15-minute counter providing a 15-minute signal every 15 minutes and a 30-minute contact providing a 30-minute signal every 30 minutes.

8. The improvement according to claim 7, wherein said time tone control circuit is responsive to said 15-minute signal and 30-minute signal for discriminating on the hour, 15 minutes after the hour, 30 minutes after the hour and 45 minutes after the hour, respectively, and for providing said time discriminating signal indicating each of these time.

* * * * *